US011410637B2

(12) United States Patent
Bonada et al.

(10) Patent No.: US 11,410,637 B2
(45) Date of Patent: Aug. 9, 2022

(54) VOICE SYNTHESIS METHOD, VOICE SYNTHESIS DEVICE, AND STORAGE MEDIUM

(71) Applicant: YAMAHA CORPORATION, Hamamatsu (JP)

(72) Inventors: Jordi Bonada, Barcelona (ES); Merlijn Blaauw, Barcelona (ES); Keijiro Saino, Hamamatsu (JP); Ryunosuke Daido, Hamamatsu (JP); Michael Wilson, Hamamatsu (JP); Yuji Hisaminato, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 32 days.

(21) Appl. No.: 16/395,737

(22) Filed: Apr. 26, 2019

(65) Prior Publication Data

US 2019/0251950 A1 Aug. 15, 2019

Related U.S. Application Data

(63) Continuation of application No. PCT/JP2017/040047, filed on Nov. 7, 2017.

(30) Foreign Application Priority Data

Nov. 7, 2016 (JP) ..... JP2016-217378

(51) Int. Cl.
*G10L 13/033* (2013.01)
*G10L 13/00* (2006.01)

(52) U.S. Cl.
CPC ..... *G10L 13/0335* (2013.01); *G10L 13/00* (2013.01); *G10L 13/033* (2013.01)

(58) Field of Classification Search
CPC ..... G10L 19/0204; G10L 13/04; G10H 7/002; G10H 1/0091
See application file for complete search history.

(56) References Cited

U.S. PATENT DOCUMENTS 5,522,012 A * 5/1996 Mammone ..... G10L 17/02 704/231
5,787,387 A * 7/1998 Aguilar ..... G10L 25/90 704/208

(Continued)

FOREIGN PATENT DOCUMENTS

JP 2014002338 A 1/2014
WO 2014142200 A1 9/2014
WO WO-2014142200 A1 * 9/2014 ..... G10H 1/0091

OTHER PUBLICATIONS

Caetano et al., Improved Estimation of the Amplitude Envelope Of Time-Domain Signals Using True Envelope Cepstral Smoothing, IEEE International Conference on Acoustics, Speech, and Signal Processing (2011) (Year: 2011).*

(Continued)

*Primary Examiner* — Anne L Thomas-Homescu
(74) *Attorney, Agent, or Firm* — Rossi, Kimms & McDowell LLP

(57) ABSTRACT

A voice synthesis method according to an embodiment includes altering a series of synthesis spectra in a partial period of a synthesis voice based on a series of amplitude spectrum envelope contours of a voice expression to obtain a series of altered spectra to which the voice expression has been imparted, and synthesizing a series of voice samples to which the voice expression has been imparted, based on the series of altered spectra.

14 Claims, 18 Drawing Sheets

(56) References Cited

U.S. PATENT DOCUMENTS 5,860,064 A * 1/1999 Henton ..... G10L 13/033 704/260
5,875,425 A * 2/1999 Nakamura ..... G10L 15/19 704/231
6,453,285 B1 * 9/2002 Anderson ..... G10L 25/78 381/94.3
6,993,483 B1 * 1/2006 Milner ..... G10L 15/30 704/236
7,248,934 B1 * 7/2007 Rossum ..... G09B 5/06 355/31
9,159,329 B1 * 10/2015 Agiomyrgiannakis ..... G10L 13/04
9,947,341 B1 * 4/2018 Marsh ..... G10L 25/18
10,026,407 B1 * 7/2018 Boucheron ..... G10L 19/032
2001/0021904 A1 * 9/2001 Plumpe ..... G10L 19/06 704/209
2002/0049583 A1 * 4/2002 Bruhn ..... G10L 19/02 704/203
2002/0049584 A1 * 4/2002 Bruhn ..... G10L 19/0208 704/205
2002/0049594 A1 * 4/2002 Moore ..... G10L 13/04 704/258
2003/0149881 A1 * 8/2003 Patel ..... H04L 9/3231 713/186
2003/0221542 A1 * 12/2003 Kenmochi ..... G10H 7/002 84/616
2004/0260544 A1 * 12/2004 Kikumoto ..... G10L 19/0204 704/221
2005/0165608 A1 * 7/2005 Suzuki ..... G10L 19/06 704/261
2007/0208569 A1 * 9/2007 Subramanian ..... G10L 19/0018 704/270
2009/0144058 A1 * 6/2009 Sorin ..... G10L 19/02 704/250
2009/0204395 A1 * 8/2009 Kato ..... G10L 13/033 704/206
2010/0177916 A1 * 7/2010 Gerkmann ..... G10L 21/0208 381/317
2010/0185713 A1 * 7/2010 Aoki ..... G06F 16/634 84/609
2012/0116754 A1 * 5/2012 Borgstrom ..... G10L 21/0208 704/205
2012/0201399 A1 * 8/2012 Mitsufuji ..... G10L 21/0388 381/98
2013/0151256 A1 * 6/2013 Nakano ..... G10L 13/0335 704/268
2014/0006018 A1 1/2014 Bonada et al.
2014/0307878 A1 * 10/2014 Osborne ..... G10H 1/0008 381/56

OTHER PUBLICATIONS

Serra et al. "Spectral Modeling Synthesis: A Sound Analysis/Synthesis System Based on a Deterministic plus Stochastic Decomposition." Computer Music Journal. Winter 1990: vol. 14, No. 4, pp. 12.24. Cited in Specification.

Bonada. "High Quality Voice Transformations Based on Modeling Radiated Voice Pulses in Frequency Domain." Oct. 5-8, 2004: DAFX-1-DAFX-6. Proceedings of the 7th International Conference on Digital Audio Effects (DAFX-04). Naples, Italy. Cited in Specification.

Bonada. "Sample-based singing voice synthesizer by spectral concatenation." Aug. 6-9, 2003: SMAC-1-SMAC-4. Proceedings of the Stockholm Music Acoustics Conference. Stockholm, Sweden. Cited in Specification.

Oppenheim, et al. "Discrete-Time Signal Processing." Pearson Higher Education, 2010:1-896 (Data available on the second edition published by Prentice Hall, 1998, see section 5.63 for minimum phase). Cited in Specification.

International Search Report issued in Intl. Appln. No. PCT/JP2017/040047 dated Jan. 30, 2018. English translation provided.

Written Opinion issued in Intl. Appln. No. PCT/JP2017/040047 dated Jan. 30, 2018.

Extended European Search Report issued in European Appln. No. 17866396.9 dated May 6, 2020.

Bonada. "Generation of growl-type voice qualities by spectral morphing." Proceedings of the IEEE International Conference on Acoustics, Speech, and Signal Processing (ICASSP). 2013: 6910-6914. Cited in NPL 1.

Office Action issued in European Appln. No. 17866396.9 dated Nov. 30, 2021.

* cited by examiner

| ROTATION ANGLE(° ) | H | G | P | I | Q | F0 |
|---|---|---|---|---|---|---|
| 0 | 0 | 0.2 | ••• | ••• | ••• | 0 |
| 30 | 0 | 0.3 | ••• | ••• | ••• | 0 |
| 60 | 0.1 | 0.4 | ••• | ••• | ••• | 0 |
| ⋮ | ⋮ | ⋮ | ⋮ | ⋮ | ⋮ | ⋮ |
| 270 | 0 | 0.7 | 0 | 0 | 0 | 0 |

VOICE SYNTHESIS METHOD, VOICE SYNTHESIS DEVICE, AND STORAGE MEDIUM

CROSS REFERENCE TO RELATED APPLICATIONS

This application is a Continuation Application of PCT Application No. PCT/JP2017/040047, filed Nov. 7, 2017, and is based on and claims priority from Japanese Patent Application No. 2016-217378, filed Nov. 7, 2016, the entire contents of each of which are incorporated herein by reference.

BACKGROUND

Technical Field

The present disclosure relates to voice synthesis.

Background Information

Known in the art are voice synthesis techniques, such as those used for singing. To enhance expressiveness of a singing voice, attempts have been made to not only output a voice with given lyrics in a given scale, but also to impart musical expressivity to the singing voice. Japanese Patent Application Laid-Open Publication No. 2014-2338 (hereafter, Patent Document 1) discloses a technology for changing a voice quality of a synthesized voice to a target voice quality. This is achieved by adjusting a harmonic component of a voice signal of a voice having the target voice quality to be within a frequency band that is close to a harmonic component of a voice signal of a voice that has been synthesized (hereafter, "synthesized voice").

In the technology disclosed in Patent Document 1, it may not be possible to impart to a synthesized voice a sufficient user-desired expressivity of a singing voice.

SUMMARY

In contrast, the present disclosure provides a technology that is able to impart to a singing voice a richer variety of voice expression.

A voice synthesis method according to an aspect of the present disclosure includes altering a series of synthesis spectra in a partial period of a synthesis voice based on a series of amplitude spectrum envelope contours of a voice expression to obtain a series of altered spectra to which the voice expression has been imparted; and synthesizing a series of voice samples to which the voice expression has been imparted, based on the series of altered spectra.

In another aspect, a voice synthesis device includes: at least one processor and a memory coupled to the processor, the memory storing instructions executable by the processor that cause the processor to: alter a series of synthesis spectra in a partial period of a synthesis voice based on a series of amplitude spectrum envelope contours of a voice expression, to obtain a series of altered spectra to which the voice expression has been imparted; and synthesize a series of voice samples to which the voice expression has been imparted, based on the series of altered spectra.

In still another aspect, a non-transitory computer storage medium stores a computer program which when executed by a computer, causes the computer to perform a voice synthesis method of: altering a series of synthesis spectra in a partial period of a synthesis voice based on a series of amplitude spectrum envelope contours of a voice expression, to obtain a series of altered spectra to which the voice expression has been imparted; and synthesizing a series of voice samples to which the voice expression has been imparted, based on the series of altered spectra.

According to the present disclosure, it is possible to provide a richer variety of voice expression.

DESCRIPTION OF THE EMBODIMENTS

1. Voice Synthesis Technology

Figure 1:
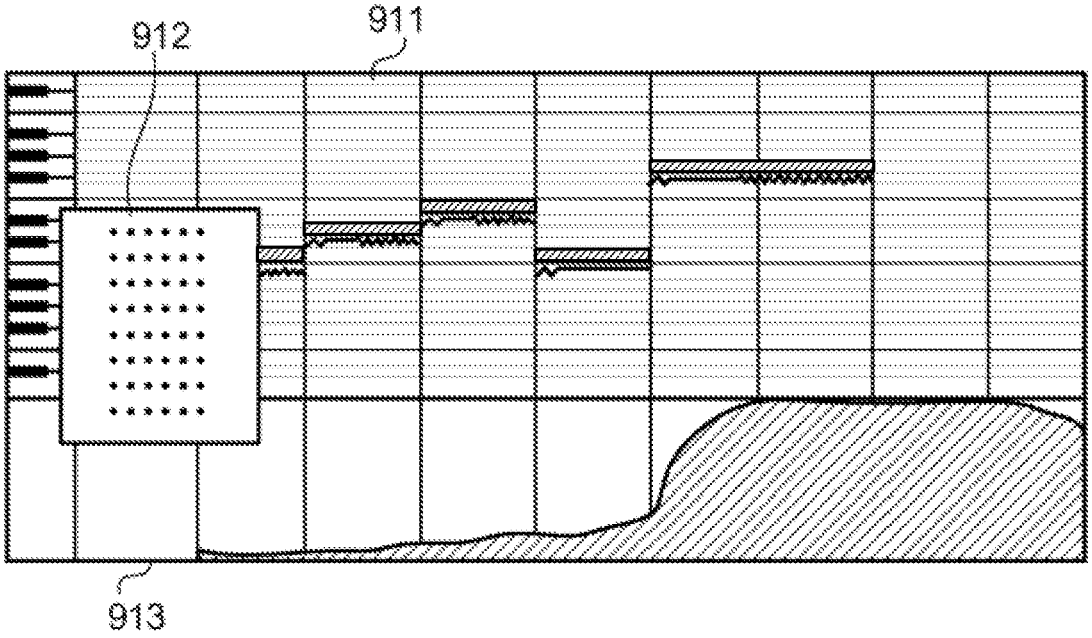
FIG. 1 is a diagram illustrating a GUI according to the related art.

Various technologies for voice synthesis are known. A voice with a change in scale and rhythm among voices is referred to as a singing voice. To achieve singing voice synthesis, there are known synthesis, which is based on sample concatenation, and statistical synthesis. To carry out singing voice synthesis based on sample concatenation, a database in which a large number of recorded singing samples are stored can be used. A singing sample, which is an example voice sample, is mainly classified by lyrics consisting of a mono-phoneme or a phoneme chain. When singing voice synthesis is performed, singing samples are connected after a fundamental frequency, a timing, and a duration are adjusted based on a score. The score designates a start time, a duration (or an end time) and lyrics for each of a series of notes constituting a song.

It is necessary for a singing sample used for singing voice synthesis based on sample concatenation to have a voice quality that is as constant as possible for all lyrics registered in the database. If the voice quality is not constant, unnatural variances will occur when a singing voice is synthesized. Further, it is necessary that, from among dynamic acoustic changes that are included in the samples, a part corresponding to a singing voice expression, which is an example of a voice expression, is not expressed in the synthesized voice when synthesis is carried out. The reason for this is because the expression of the singing voice is to be imparted to a singing voice in accordance with a musical context, and does not have any direct association with lyric types. If a same expression of the singing voice is repeatedly used for a specific lyric type, the result will be unnatural. Thus, in carrying out singing voice synthesis based on sample concatenation, changes in fundamental frequency and volume, which are included in the singing sample, are not directly used, but changes in fundamental frequency and volume generated based on the score and one or more predetermined rules are instead used. Assuming that singing samples corresponding to all combinations of lyrics and expressions of singing voices are recorded in a database, a singing sample appropriate for a lyric type in a score and that imparts a natural expression to a singing voice in a specific musical context could be selected. In practice, such an approach is time and labor consuming, and if singing samples corresponding to all expressions of the singing voice for all lyric types were to be recorded, a huge storage capacity would be required. In addition, since a number of combinations of samples increases exponentially relative to a number of samples, there is no guarantee that an unnatural synthesized voice will be avoided for each and every sample relation.

On the other hand, using statistical singing voice synthesis, a relationship between a score and features pertaining to a spectrum of a singing voice (hereafter, "spectral features") is learned in advance as a statistical model by using voluminous training data. Upon carrying out synthesis, the most likely spectral features are estimated with reference to the input score, and the singing voice is then synthesized using the spectral features. In carrying out statistical singing voice synthesis, it is possible to learn a statistical model that includes a richly expressive range of singing voices, by training data applicable to a wide range of different singing styles. Notwithstanding, two specific problems arise in carrying out statistical singing voice synthesis. The first problem is excessive smoothing. A process of learning a statistical model using voluminous training data involves that the data be averaged, which results in degradation of dimensional variance of spectral features, and inevitably causes a synthesized output to lack the expressivity of even an average single singing voice. As a result, expressivity and realism of the synthesized voice is far from satisfactory. The second problem is that types of spectral features from which the statistical model can be learned are limited. In particular, due to the cyclical value range of phase information, it is difficult to carry out satisfactory statistical modeling. For example, it is difficult to appropriately model a phase relationship between harmonic components or between a specific harmonic component and a component proximate to the specific harmonic component, and the modeling of a temporal variation thereof is also a difficult task. However, if a richly expressive singing voice is to be synthesized, including deep and husky characteristics, it is important that the phase information is appropriately used.

Voice quality modification (VQM) described in Patent Document 1 discloses a technology for carrying out synthesis to produce a variety of singing voice qualities. In the VQM, there are used a first voice signal of a voice corresponding to a particular singing voice expressivity, together with a second voice signal of a synthesized singing voice. The second voice signal may be of a singing voice that is synthesized based on sample concatenation, or it may be of a voice that is synthesized based on statistical analysis. By use of the two voice signals, singing voices with appropriate phase information are synthesized. As a result, a realistic singing voice that is rich in expressivity is synthesized, in contrast to ordinary singing voice that is synthesized. It is of note, however, that use of this technology, does not enable a temporal change in the spectral features of a first voice signal to be adequately reflected in the synthesized singing voice. It is also of note that the temporal change of interest here includes not only a rapid change in spectral features that occurs with steady utterance of a deep voice and a husky voice, but also, for example, upon transition in a voice quality over a relatively long period of time (a macroscopic transition), where a substantial amount of rapid variation occurs upon commencement of utterance, and gradually reduces over time, and then stabilizes with a further lapse of time. Depending on an expressivity of a voice, substantial changes in voice quality may occur.

FIG. 1 is a diagram illustrating a GUI according to an embodiment of the present disclosure. This GUI can also be used in a singing voice synthesis program of the related art (for example, VQM). The GUI includes a score display area 911, a window 912, and a window 913. The score display area 911 is an area in which a score for voice synthesis is displayed. In this example, each note designated by the score is expressed in a format corresponding to a piano roll. In the score display area 911, the horizontal axis indicates time and the vertical axis indicates a scale. The window 912 is a pop-up window that is displayed dependent on a user operation, and includes a list of expressions of singing voices that can be imparted to a synthesized voice. The user selects from this list a desired expression of the singing voice to be imparted to a particular note of the synthesized voice. A graph representing an extent of application of the selected expression of the singing voice is displayed in the window 913. In the window 913, the horizontal axis indicates time and the vertical axis indicates a depth of application of the expression of the singing voice (a mixing ratio in the VQM described above). The user edits the graph in the window 913 and inputs a temporal change in the depth of the application of the VQM. However, in the VQM, a transition of a macroscopic voice quality (a temporal change in the spectrum) cannot be adequately reproduced by use of a temporal change in a depth of the application input by the user, and as a result it is difficult to synthesize natural singing voices that are richly expressive.

2. Configuration

Figure 2:
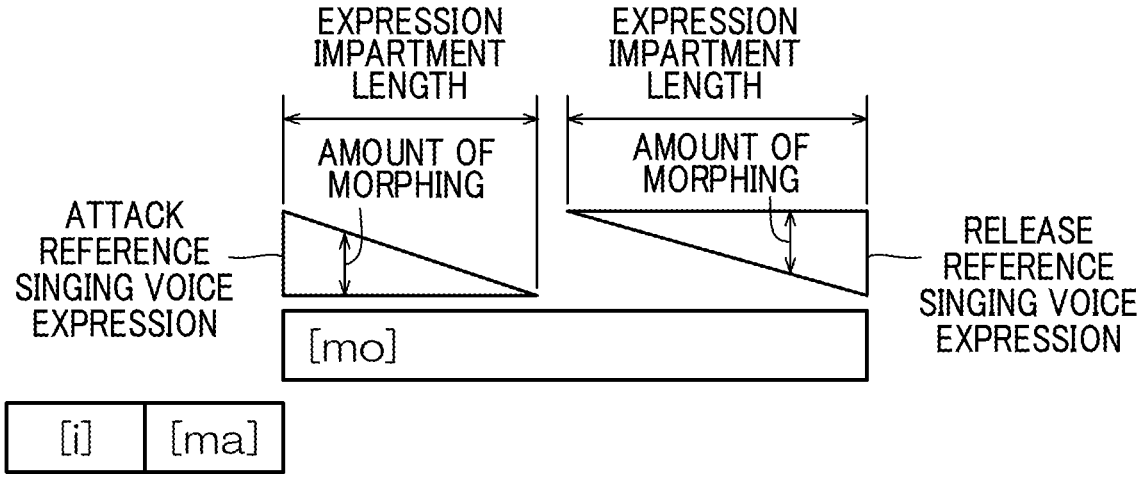
FIG. 2 is a diagram illustrating a concept of imparting an expression of a singing voice according to an embodiment.

FIG. 2 is a diagram illustrating a concept of imparting expression to a singing voice according to an embodiment. It is of note that hereafter, the term "synthesized voice" refers to a synthesized voice and, more particularly, to a voice that has assigned thereto both a scale and a lyric. Unless otherwise specified, the term "synthesized voice", refers to a synthesized voice to which the expression of the singing voice according to the embodiment has not been imparted. The phrase "expression of the singing voice" refers to a musical expression imparted to the synthesized voice, and includes expressivity such as vocal fry, growl, and roughness. In the embodiment, positioning a desired sample from among available samples of a temporally limited expression of the singing voice (hereafter referred to as an "expressive sample") recorded in advance on a time axis in an ordinary (no expression has been imparted to the singing voice) synthesized voice, and morphing on the synthesized voice thereafter is together referred to as "imparting the expression of the singing voice to the synthesized voice". Here, the expressive sample (a series of voice samples) is temporally limited with respect to the entire synthesized voice or one note. The phrase "temporally limited" refers to a limited time duration for the expression of the singing voice, relative to the entire synthesized voice or to one note only. The expressive sample is an expression of a singing voice of a singer that has been recorded in advance, and is a sample of a singing voice expression (a musical expression) that is made within a limited singing-time duration. The sample is obtained by converting into data a part of a voice waveform uttered by a singer. Morphing is a process (an interpolation process) of multiplying at least one of an expressive sample positioned in a certain range or a synthesized voice in the range, by a coefficient that increases or decreases with a lapse of time, and then adding together the expressive sample and the synthesized voice. The expressive sample is positioned at a timing in alignment with that of an ordinary synthesized voice, after which the morphing is performed. A temporal change in the spectral features in the expression of the singing voice is imparted to the synthesized voice by morphing. Morphing of the expressive sample is performed on a section, of an ordinary synthesized voice, within a limited time duration.

In this example, a reference time for addition of the synthesized voice and the expressive sample is a head time of the note or an end time of the note. Hereafter, setting the head time of the note as a reference time is referred to as an "attack reference", and setting the end time as a reference time is referred to as a "release reference".

Figure 3:
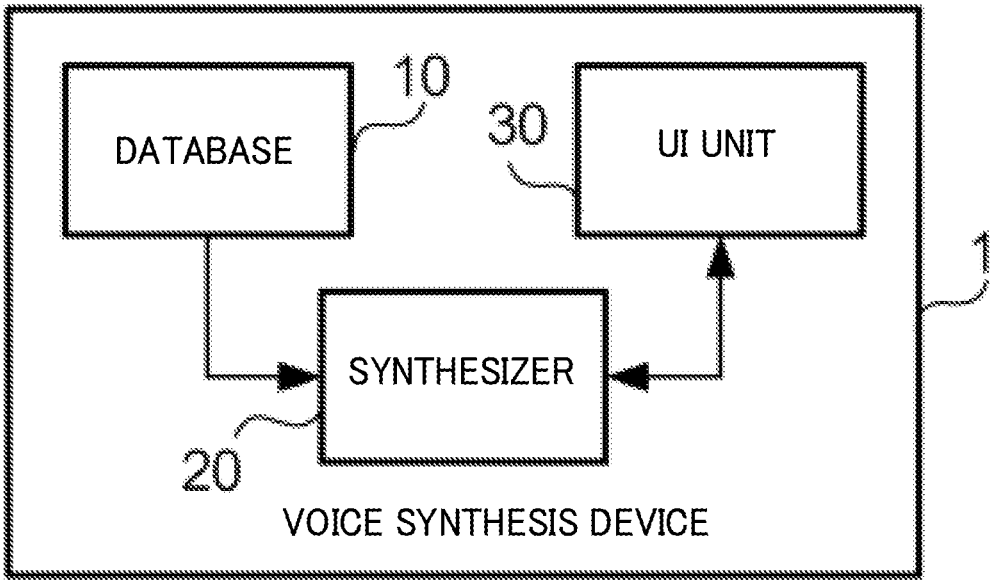
FIG. 3 is a diagram illustrating a functional configuration of a voice synthesis device 1 according to the embodiment.

FIG. 3 is a diagram illustrating a functional configuration of the voice synthesis device 1 according to an embodiment. The voice synthesis device 1 includes a database 10, a synthesizer 20, and a user interface (UI) 30. In this example, singing voice synthesis based on sample concatenation is used. The database 10 is a database in which recorded singing samples and expressive samples have been stored. The synthesizer 20 reads singing samples and expressive samples from the database 10 based on the score in which there is depicted a series of notes of a piece of music along with information indicating an expression of the singing voice. These pieces of information are used to synthesize a voice having the expression of the singing voice. The UI unit 30 is an interface for carrying out inputting or editing of the score and the expression of the singing voice, outputting of the synthesized voice, and a display of results of the inputting or editing (that is, outputting to the user).

Figure 4:
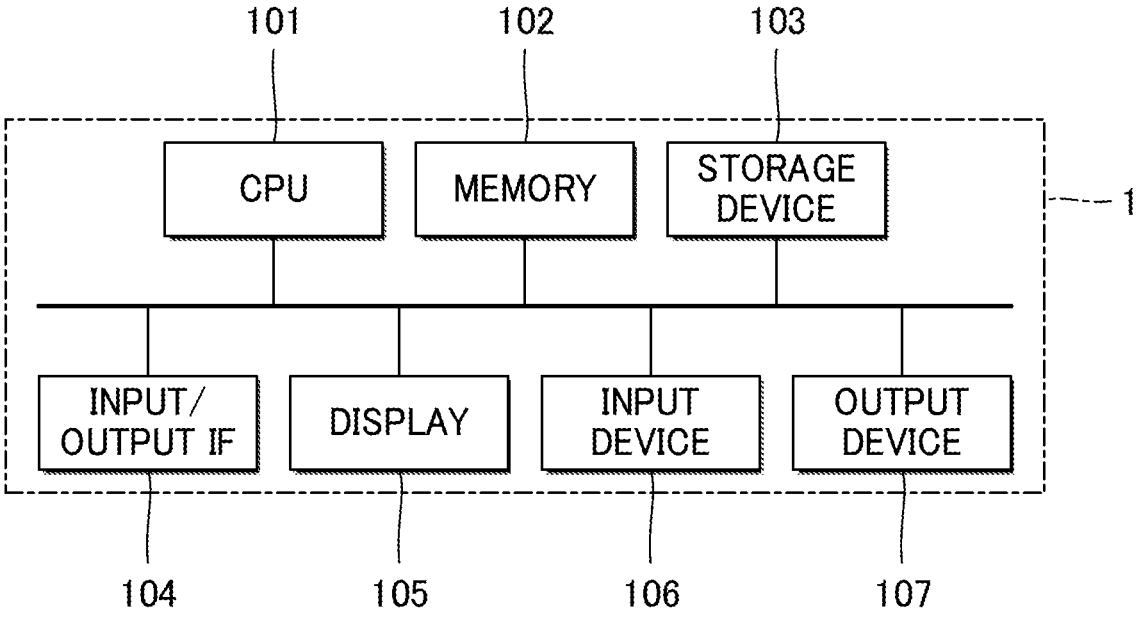
FIG. 4 is a diagram illustrating a hardware configuration of the voice synthesis device 1.

FIG. 4 is a diagram illustrating a hardware configuration of the voice synthesis device 1. The voice synthesis device 1 is a computer device including a central processing unit (CPU) 101, a memory 102, a storage device 103, an input/output IF 104, a display 105, an input device 106, and an output device 107, such as, specifically, a tablet terminal. The CPU 101 is a control device that executes a program to control other elements of the voice synthesis device 1. The memory 102 is a main storage device and includes, for example, a read only memory (ROM) and a random access memory (RAM). The ROM stores, for example, a program for activating the voice synthesis device 1. The RAM functions as a work area when the CPU 101 executes the program. The storage device 103 is an auxiliary storage device and stores various pieces of data and programs. The storage device 103 includes, for example, at least one of a hard disk drive (HDD) or a solid state drive (SSD). The input/output IF 104 is an interface for inputting or outputting information from or to other devices, and includes, for example, a wireless communication interface or a network interface controller (NIC). The display 105 is a device that displays information and includes, for example, a liquid crystal display (LCD). The input device 106 is a device for inputting information to the voice synthesis device 1, and includes, for example, at least one of a touch screen, a keypad, a button, a microphone, or a camera. The output device 107 is, for example, a speaker, for output in the form of sound waves the synthesized voice to which the expression of the singing voice has been imparted.

In this example, the storage device 103 stores a computer program that causes a computer device to function as the voice synthesis device 1 (hereafter, referred to as a "singing voice synthesis program"). By the CPU 101 executing the singing voice synthesis program, functions as shown in FIG. 3 are implemented in the computer device. The storage device 103 is an example of a storage unit that stores the database 10. The CPU 101 is an example of the synthesizer 20. The CPU 101, the display 105, and the input device 106 are examples of the UI unit 30. Hereinafter, the details of the functional elements in FIG. 3 will be described.

2-1. Database 10

The database 10 includes a database (a sample database) in which recorded singing samples are stored, and a database (a singing voice expression database) in which expressive samples are recorded and stored. Since the sample database is the same as a conventional database used for the singing voice synthesis based on sample concatenation, detailed description thereof will be omitted. Hereafter, the singing voice expression database is simply referred to as the database 10, unless otherwise specified. The spectral features of the expressive sample can be estimated in advance, and the estimated spectral features can be recorded in the database 10, to achieve both reduction in calculation load at the time of singing voice synthesis and prevention of an estimation error of the spectral features. The spectral features recorded in the database 10 may be corrected manually.

Figure 5:
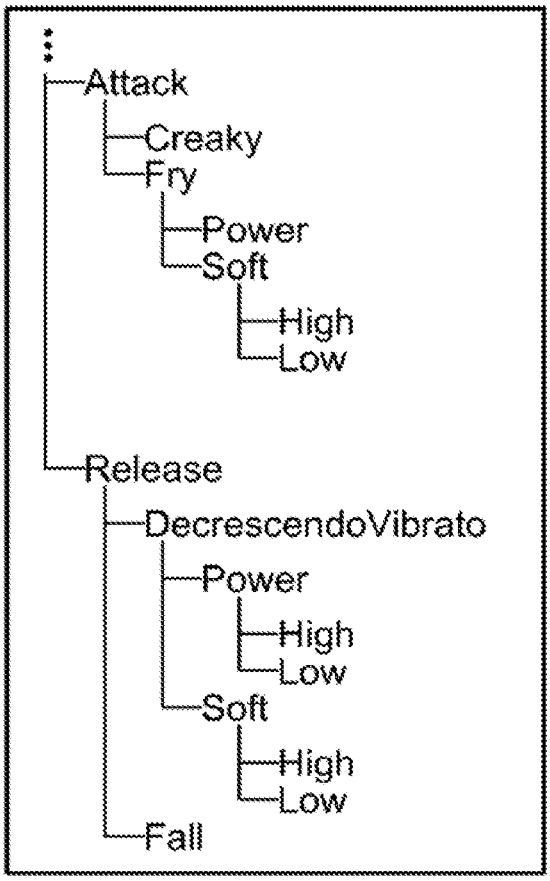
FIG. 5 is a schematic diagram illustrating a structure of a database 10.

FIG. 5 is a schematic diagram illustrating a structure of the database 10. The expressive samples are recorded and are stored in an organized manner in the database 10 so that a user or a program can easily find a desired expression of the singing voice. FIG. 5 illustrates an example of a tree structure. Each of a leave at terminals in the tree structure corresponds to one expression of the singing voice. For example, "Attack-Fry-Power-High" refers to a singing voice expression suitable for use in a high-frequency range with a strong voice quality among singing voice expressions with an attack reference mainly including the fry utterance. Expressions of the singing voice may be set not only at the leaves at the terminals of the tree structure but also at nodes. For example, the singing voice expressions corresponding to "Attack-Fry-Power" may be recorded, in addition to the above example.

In the database 10, at least one sample per expression of the singing voice is recorded. Two or more samples may be recorded depending on lyrics. It is not necessary for a unique expressive sample to be recorded for each and every lyrics. This is because the expressive sample is morphed with a synthesized voice, as a result of which the basic quality of a singing voice has already been secured. For example, in order to obtain a singing voice having good quality in the singing voice synthesis based on sample concatenation, it is necessary to record a sample for each lyric of a 2-phoneme chain (for example, a combination of /a-i/ or /a-o/). However, a unique expressive sample may be recorded for each mono-phoneme (for example, /a/ or /o/), or a number may be reduced and one expressive sample (for example, only /a/) may be recorded per expression of the singing voice. A human database creator determines a number of samples to be recorded for each expression of the singing voice while balancing an amount of time for creation of the singing voice expression database and a quality of the synthesized voice. An independent expressive sample is recorded for each lyric in order to obtain a higher quality (realistic) synthesized voice. The number of samples per expression of the singing voice is reduced in order to reduce the amount of time for creation of the singing voice expression database.

When two or more samples are recorded per expression of the singing voice, it is necessary to define mapping (association) between the sample and the lyrics. An example is given in which, for a certain expression of the singing voice, a sample file "S0000" is mapped to lyrics /a/ and /i/, and a sample file "S0001" is mapped to lyrics /u/, /e/, and /o/. Such mapping is defined for each expression of the singing voice. The number of recorded samples stored in the database 10 may be different for each of the expressions of the singing voice. For example, two samples may be recorded for a particular expression of the singing voice, while five samples may be recorded for another expression of the singing voice.

Figure 6:
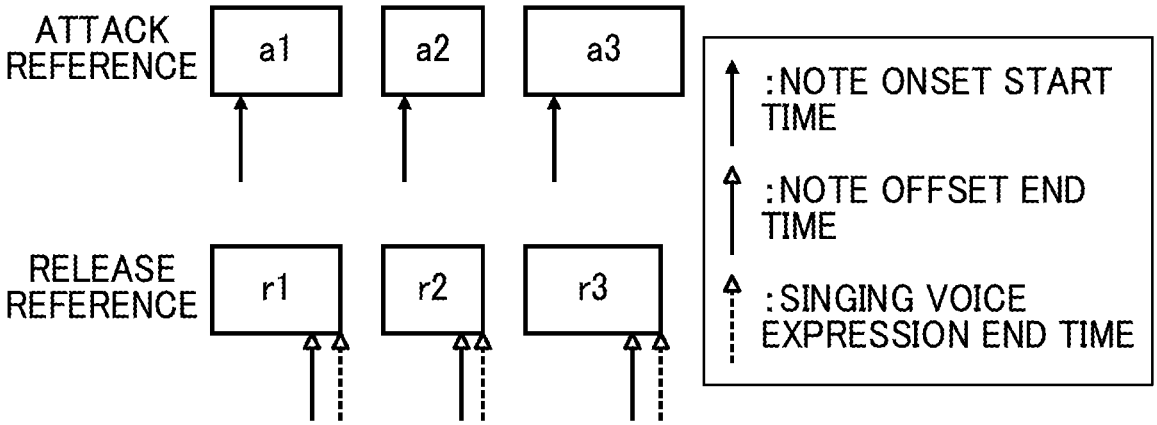
FIG. 6 is a diagram illustrating a reference time stored for each expressive sample.

Information indicating an expression reference time is stored for each expressive sample in the database 10. This expression reference time is a feature point on the time axis in a waveform of the expressive sample. The expression reference time includes at least one of a singing voice expression start time, a singing voice expression end time, a note onset start time, a note offset start time, a note onset end time, or a note offset end time. For example, as shown in FIG. 6, the note onset start time is stored for each expressive sample with the attack reference (codes a1, a2, and a3 in FIG. 6). For each expressive sample with the release reference (codes r1, r2, and r2 in FIG. 6), the note offset end time and/or the singing voice expression end time is stored. As will be apparent from FIG. 6, time lengths of expressive samples differ for each expressive sample.

Figure 7:
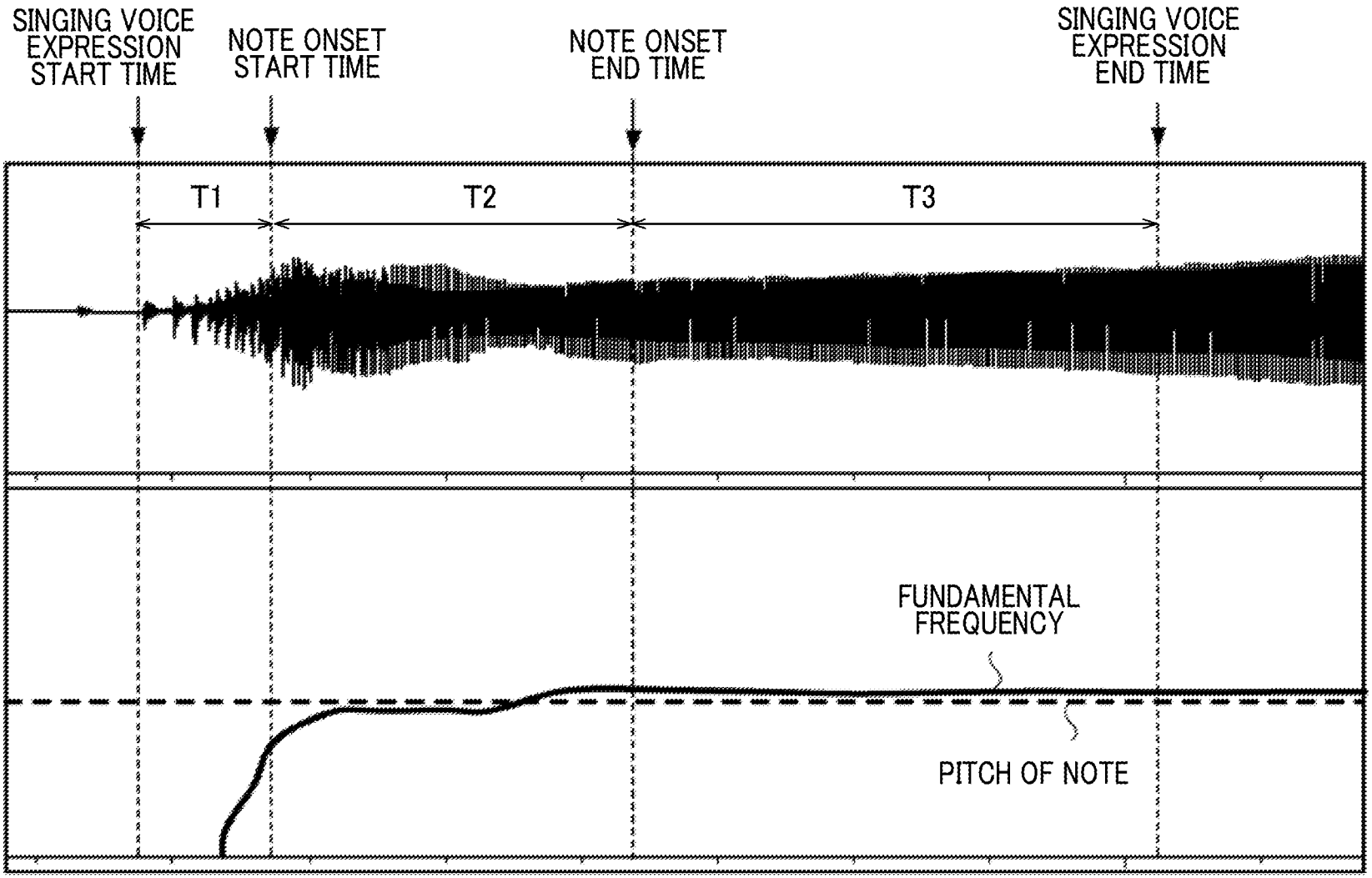
FIG. 7 is a diagram illustrating a reference time for a singing voice expression with an attack reference.
Figure 8:
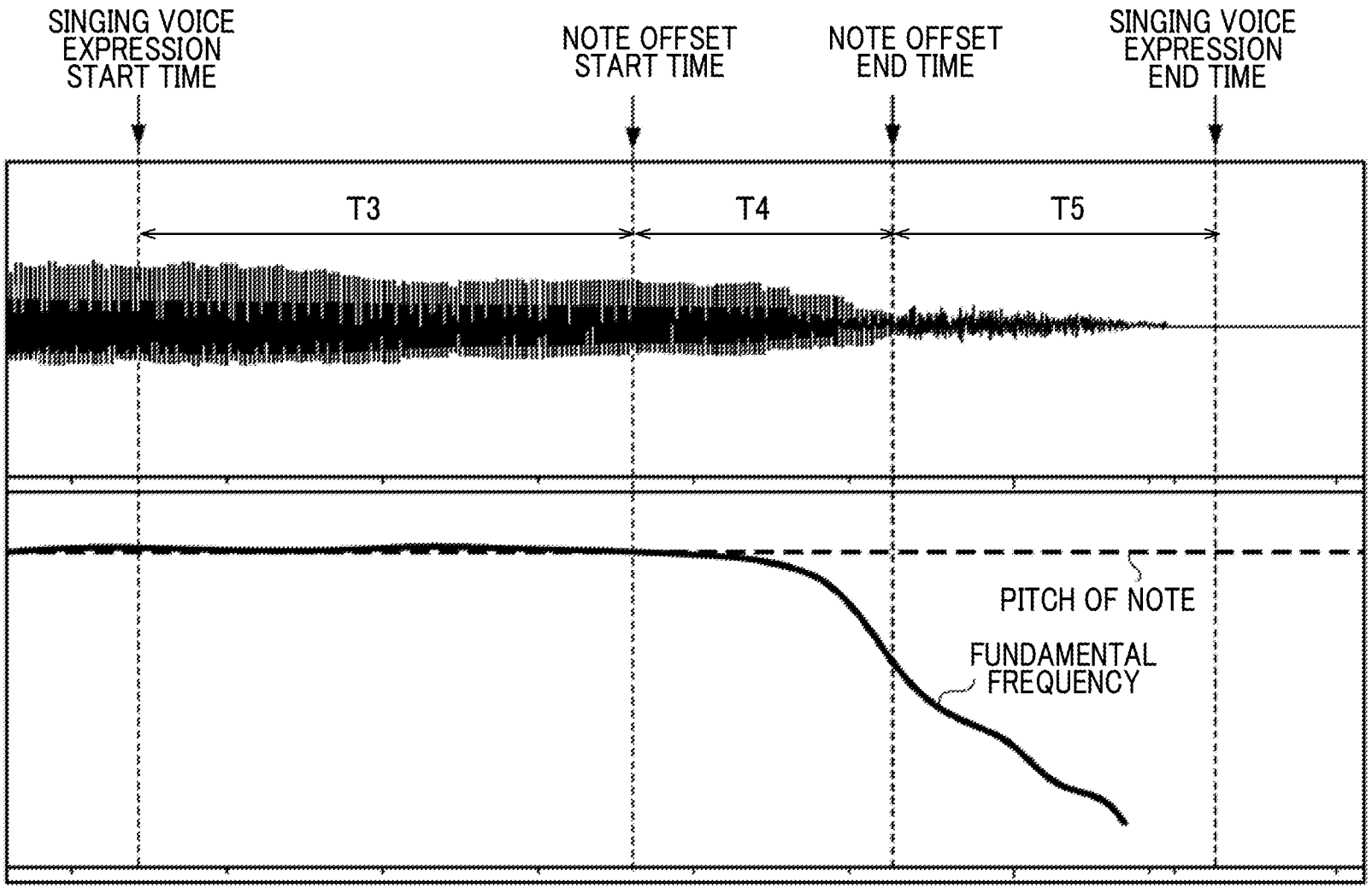
FIG. 8 is a diagram illustrating a reference time for a singing voice expression with a release reference.

FIGS. 7 and 8 are diagrams illustrating each expression reference time. In this example, a voice waveform of the expressive sample on the time axis is divided into a pre-section T1, an onset section T2, a sustain section T3, an offset section T4, and a post section T5. These sections are classified, for example, by a creator of the database 10. FIG. 7 illustrates a singing voice expression with the attack reference, and FIG. 8 illustrates a singing voice expression with the release reference.

As shown in FIG. 7, the singing voice expression with the attack reference is divided into a pre-section T1, an onset section T2, and a sustain section T3. The sustain section T3 is a section in which a specific type of spectral features (for example, a fundamental frequency) is stabilized in a predetermined range. The fundamental frequency in the sustain section T3 corresponds to a pitch of this expression of the singing voice. The onset section T2 is a section before the sustain section T3 and is a section in which the spectral features changes with time. The pre-section T1 is a section before the onset section T2. In the singing voice expression with the attack reference, a start point of the pre-section T1 is the singing voice expression start time. A start point of the onset section T2 is the note onset start time. An end point of the onset section T2 is the note onset end time. An end point of the sustain section T3 is the singing voice expression end time.

As shown in FIG. 8, the singing voice expression with the release reference is divided into a sustain section T3, an offset section T4, and a post section T5. The offset section T4 is a section after the sustain section T3 and is a section in which predetermined types of spectral features change with time. The post section T5 is a section after the offset section T4. A start point of the sustain section T3 is the singing voice expression start time. An end point of the sustain section T3 is the note offset start time. An end point of the offset section T4 is the note offset end time. An end point of the post section T5 is the singing voice expression end time.

A template of parameters to be applied to singing voice synthesis is recorded in the database 10. The parameters referred to herein include, for example, a temporal transition in an amount of morphing (a coefficient), a time length of morphing (hereinafter referred to as an "expression impartment length"), and a speed of the expression of the singing voice. FIG. 2 shows the temporal transition in the amount of morphing and the expression impartment length. For example, templates may be created by the database creator, and the database creator may determine a template to be applied to each expression of the singing voice in advance. That is, a template to be applied to a certain expression of the singing voice may be determined in advance. Alternatively, the templates may be included in the database 10 and the user may select a template to be used at the time of expression impartment.

2-2. Synthesizer 20

Figure 9:
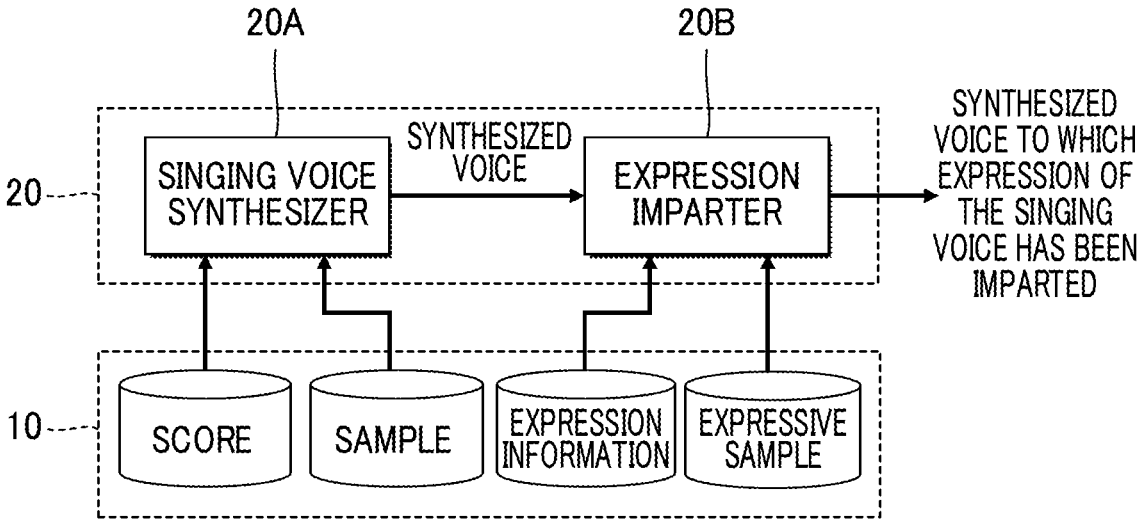
FIG. 9 is a diagram illustrating a functional configuration of a synthesizer.

FIG. 9 is a diagram illustrating a functional configuration of the synthesizer 20. As shown in FIG. 9, the synthesizer 20 includes a singing voice synthesizer 20A and an expression imparter 20B. The singing voice synthesizer 20A generates a voice signal representing a synthesized voice specified by a score through singing voice synthesis based on sample concatenation using a singing sample. It is of note that the singing voice synthesizer 20A may generate a voice signal representing the synthesized voice designated by the score by the above-described statistical singing voice synthesis using a statistical model or any other known synthesis scheme.

Figure 10:
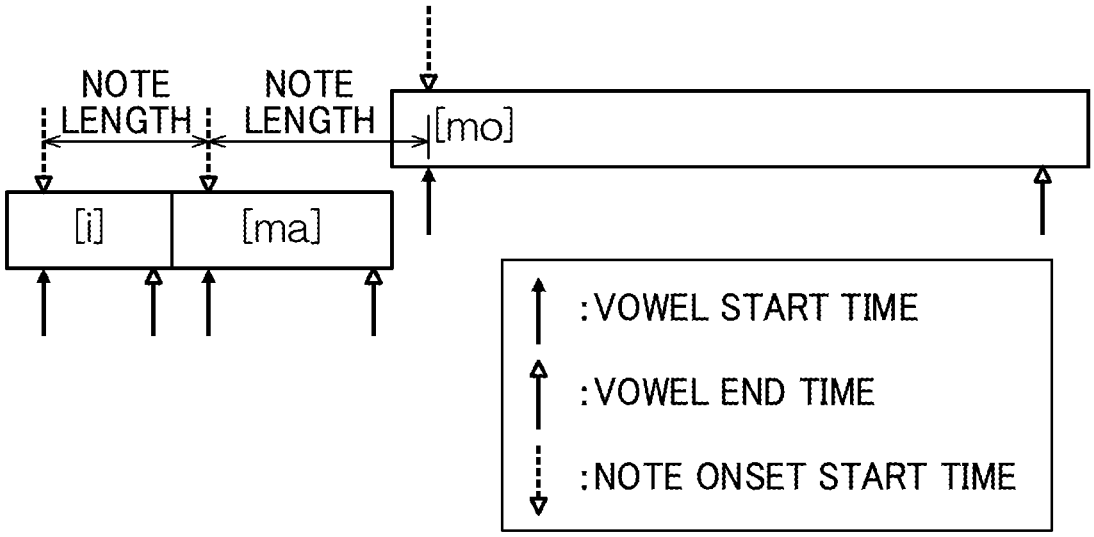
FIG. 10 is a diagram illustrating a vowel start time, a vowel end time, and a pronunciation end time.

As shown in FIG. 10, the singing voice synthesizer 20A determines, on the basis of the score, a time at which the pronunciation of a vowel starts in the synthesized voice (hereafter, a "vowel start time"), a time at which the pronunciation of the vowel ends (hereafter, a "vowel end time"), and a time at which the pronunciation ends (hereafter, a "pronunciation end time") at the time of singing voice synthesis. The vowel start time, the vowel end time, and the pronunciation end time of the synthesized voice are all times of feature points of the synthesized voice that is synthesized on the basis of the score. In a case where there is no score, each of these times may be obtained by analyzing the synthesized voice.

Figure 11:
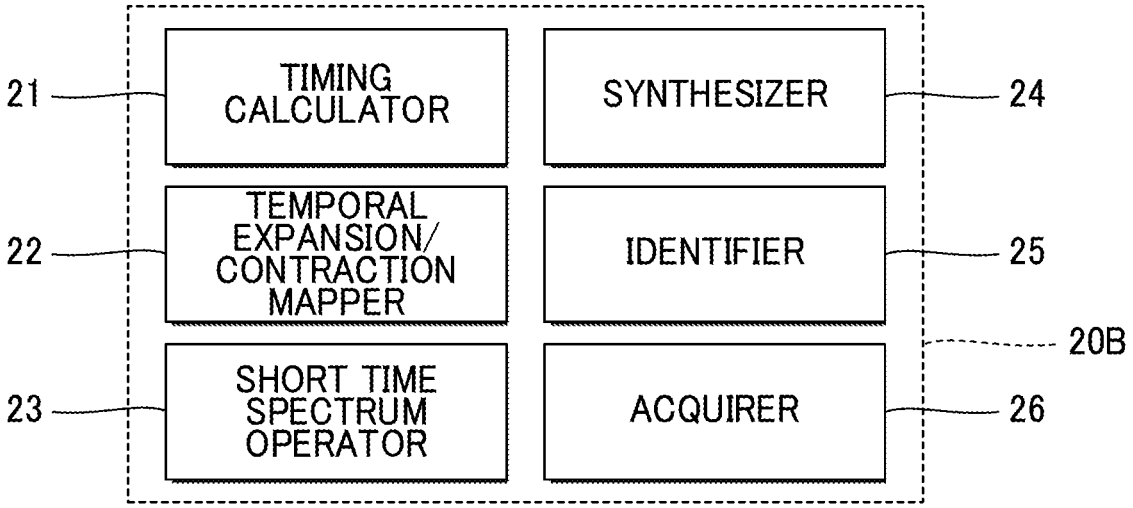
FIG. 11 is a diagram illustrating a functional configuration of an expression imparter 20B.

The expression imparter 20B in FIG. 9 imparts the expression of the singing voice to the synthesized voice generated by the singing voice synthesizer 20A. FIG. 11 is a diagram illustrating a functional configuration of the expression imparter 20B. As shown in FIG. 11, the expression imparter 20B includes a timing calculator 21, a temporal expansion/contraction mapper 22, a short-time spectrum operator 23, a synthesizer 24, an identifier 25, and an acquirer 26.

Using the expression reference time recorded for the expressive sample, the timing calculator 21 calculates an amount of timing adjustment for matching the expressive sample with a predetermined timing of the synthesized voice. The amount of timing adjustment corresponds to a position on a time axis on which the expressive sample is set for the synthesized voice.

An operation of the timing calculator 21 will be described with reference to FIGS. 2 and 10. As shown in FIG. 10, the timing calculator 21 positions an expressive sample of the attack reference so that a note onset start time of the expressive sample, which is an example of an expression reference time, aligns with a vowel start time or a note start time of a synthesized voice, by adjusting the amount of timing adjustment of the expressive sample. The timing calculator 21 positions the expressive sample with the release reference so that a note offset end time of the expressive sample, which is another example of the expression reference time, aligns with a vowel end time of the synthesized voice or the singing voice expression end time aligns with the pronunciation end time of the synthesized voice, by adjusting the amount of timing adjustment of the expressive sample.

The temporal expansion/contraction mapper 22 calculates temporal expansion or contraction mapping of the expressive sample positioned on the synthesized voice on the time axis (performs an expansion process on the time axis). Here, the temporal expansion/contraction mapper 22 calculates a mapping function representing a time correspondence between the synthesized voice and the expressive sample. A mapping function to be used here is a nonlinear function in which each expressive sample expands or contracts differently for each section based on the expression reference time of an expressive sample. Using such a function, the expression of the singing voice can be added to the synthesized voice while minimizing loss of the nature of the expression of the singing voice included in the sample. The temporal expansion/contraction mapper 22 performs temporal expansion on feature portions in the expressive sample using an algorithm differing from an algorithm used for portions other than the feature portions (that is, using a different mapping function). The feature portions are, for example, a pre-section T1 and an onset section T2 in the expression of the singing voice with the attack reference, as will be described below.

FIGS. 12A to 12D are diagrams illustrating a mapping function in an example in which the positioned expressive sample has a shorter time length than an expression impartment length of the synthesized voice on the time axis. This mapping function may be used, for example, when the expressive sample has a shorter time length than the expression impartment length in a case where the expressive sample of the singing voice expression with the attack reference is used for morphing, in voice synthesizing a specific note. First, the basic idea of the mapping function will be described. In the expressive sample, a larger dynamic variation in the spectral features as an expression of the singing voice is included in the pre-section T1 and the onset section T2. Therefore, expanding or contracting this section over time will change the nature of the expression of the singing voice. Therefore, the temporal expansion/contraction mapper 22 obtains desired temporal expansion/contraction mapping by prolonging the sustain section T3, while avoiding temporal expansion or contraction as much as possible in the pre-section T1 and the onset section T2.

Figure 12A:
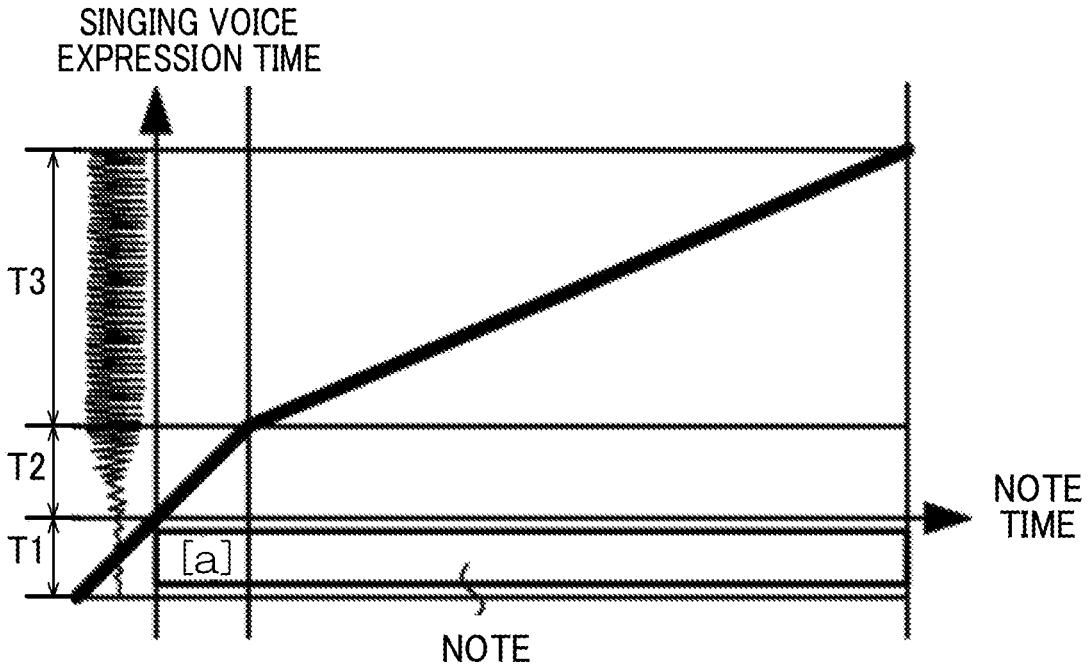
FIG. 12A is a diagram illustrating a mapping function in an example in which a time length of an expressive sample is short.
Figure 12B:
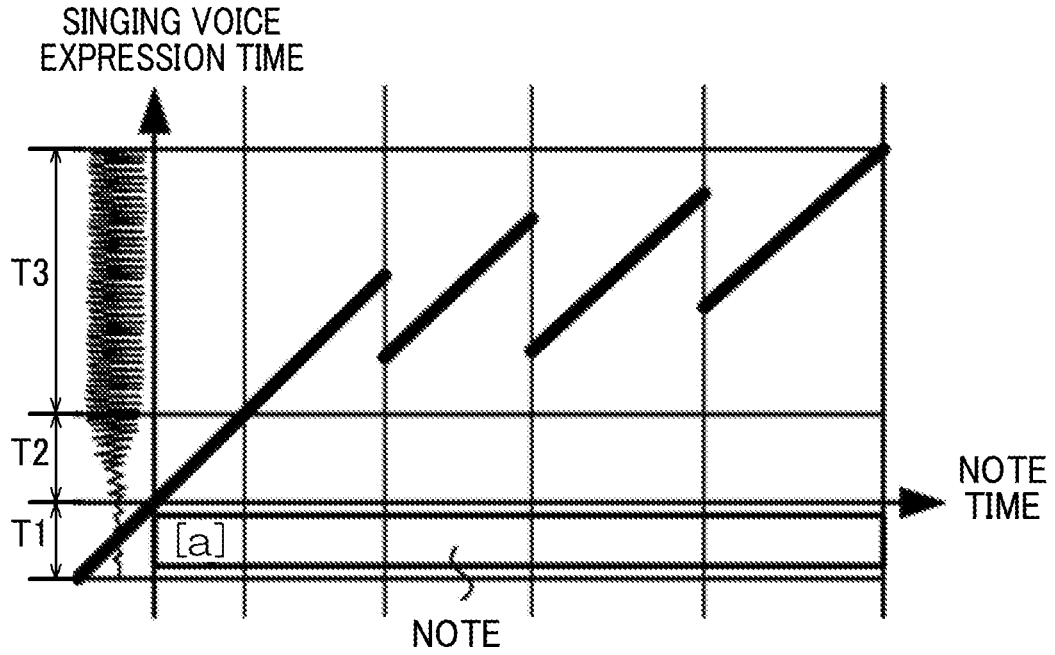
FIG. 12B is a diagram illustrating a mapping function in an example in which the time length of the expressive sample is short.
Figure 12C:
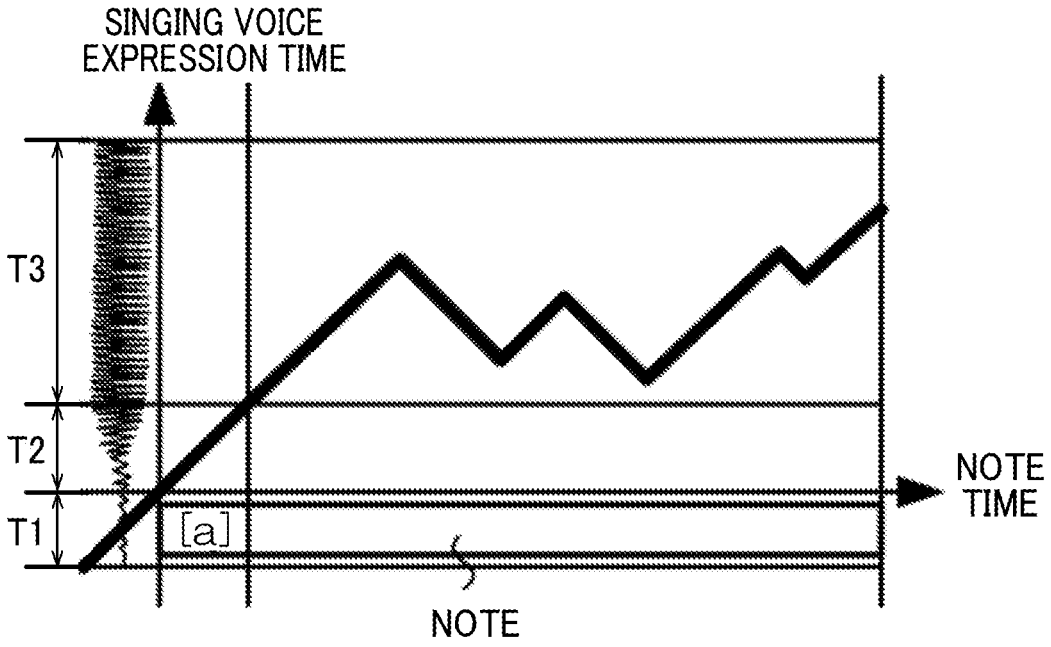
FIG. 12C is a diagram illustrating a mapping function in an example in which the time length of the expressive sample is short.

As shown in FIG. 12A, the temporal expansion/contraction mapper 22 makes the slope of a mapping function gentle for the sustain section T3. For example, the temporal expansion/contraction mapper 22 prolongs the time of the entire sample by delaying a data readout speed of the expressive sample. FIG. 12B illustrates an example in which the time of the entire sample is prolonged by returning to a previous data readout position multiple times, with the readout speed kept constant in the sustain section T3. The example of FIG. 12B is an example that utilizes characteristics that the spectrum is maintained substantially steadily in the sustain section T3. In this case, a data readout position before it returns and a previous data readout position can correspond to a start position and an end position of the temporal periodicity appearing in the spectrum. Adopting such a data reading position enables the generation of a synthesized voice to which a natural expression of the singing voice has been imparted. For example, an autocorrelation function for the series of the spectral features of the expressive sample is obtained, so that the peaks of the autocorrelation function are determined as a start position and an end position. FIG. 12C illustrates an example in which a so-called random-mirror-loop is applied to prolong the time of the entire sample in the sustain section T3. The random-mirror-loop is a scheme for prolonging the time of the entire sample by inverting a sign of the data readout speed multiple times during readout. In order to avoid artificial periodicity not originally included in the expressive sample from occurring, a time at which the sign is inverted is determined on the basis of a pseudo random number.

Figure 12D:
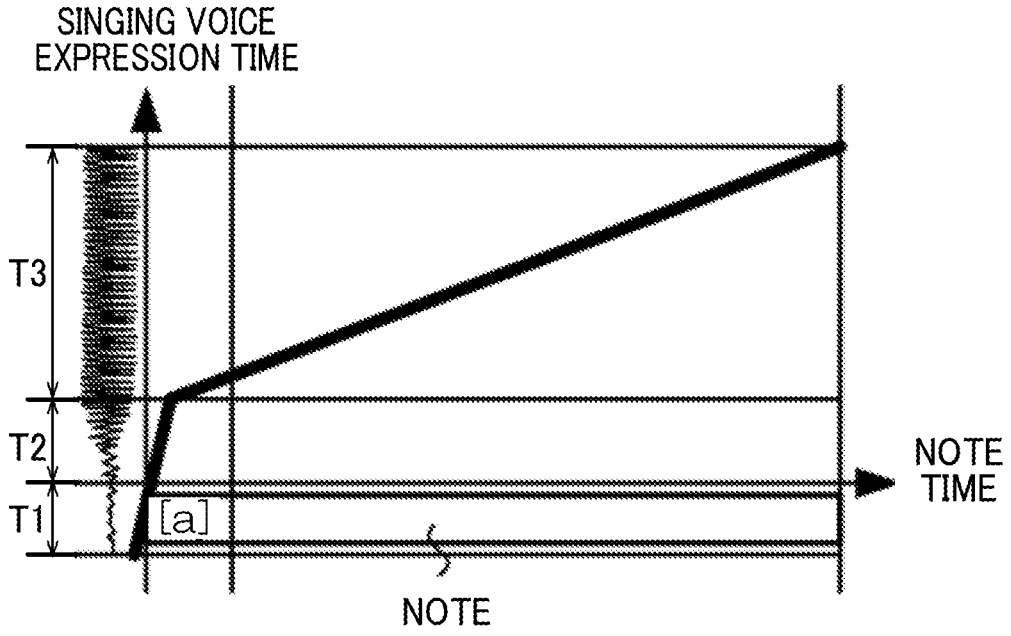
FIG. 12D is a diagram illustrating a mapping function in an example in which the time length of the expressive sample is short.

FIGS. 12A to 12C show examples in which the data readout speed in the pre-section T1 and the onset section T2 is not changed. However, the user may sometimes desire to adjust the speed of the expression of the singing voice. For example, in an expression of the singing voice of "sob", the user may desire to make the expression of the singing voice faster than the expression of the singing voice recorded as a sample. In such a case, the data readout speed may change in the pre-section T1 and the onset section T2. Specifically, when the user desires to make the expression of the singing voice faster than the sample, the data readout speed is increased. FIG. 12D illustrates an example in which the data readout speed is increased in the pre-section T1 and the onset section T2. In the sustain section T3, the data readout speed is reduced, and the time of the entire sample is prolonged.

FIGS. 13A to 13D are diagrams illustrating a mapping function that is used when the positioned expressive sample has a longer time length than the expression impartment length of the synthesized voice on the time axis. This mapping function is used, for example, when the expressive sample has a longer time length than the expression impartment length in a case where the expressive sample of the singing voice expression with the attack reference is used for morphing, in voice synthesizing a specific note. In the examples of FIGS. 13A to 13D, the temporal expansion/contraction mapper 22 obtains desired temporal expansion/contraction mapping by shortening the sustain section T3 while avoiding temporal expansion or contraction as much as possible in the pre-section T1 and the onset section T2.

Figure 13A:
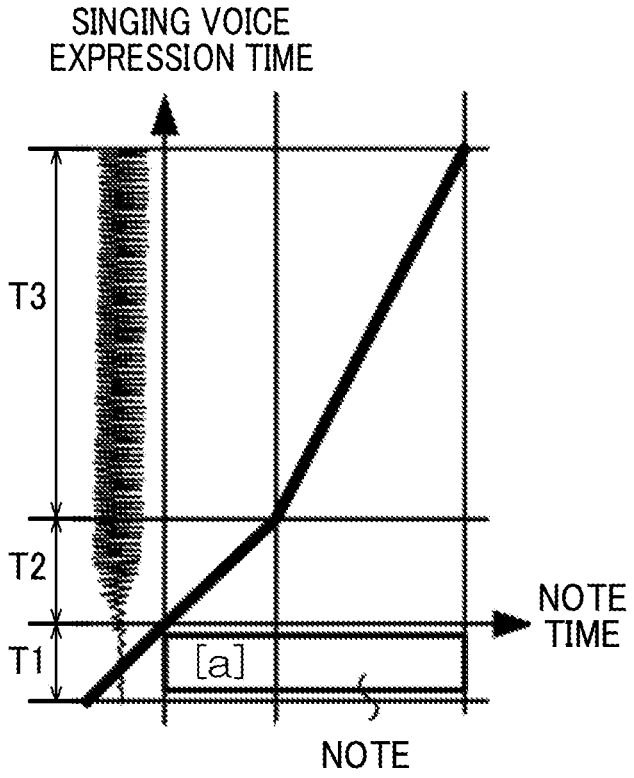
FIG. 13A is a diagram illustrating a mapping function in an example in which the time length of the expressive sample is long.
Figure 13B:
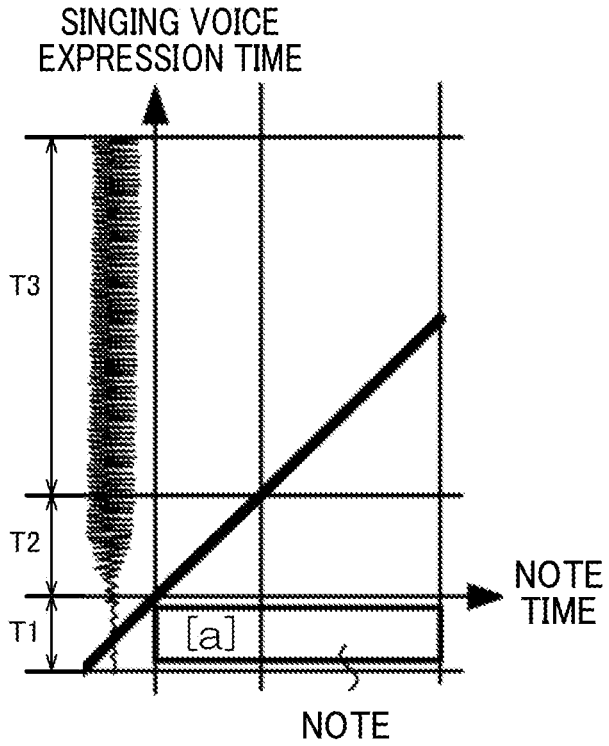
FIG. 13B is a diagram illustrating a mapping function in an example in which the time length of the expressive sample is long.
Figure 13C:
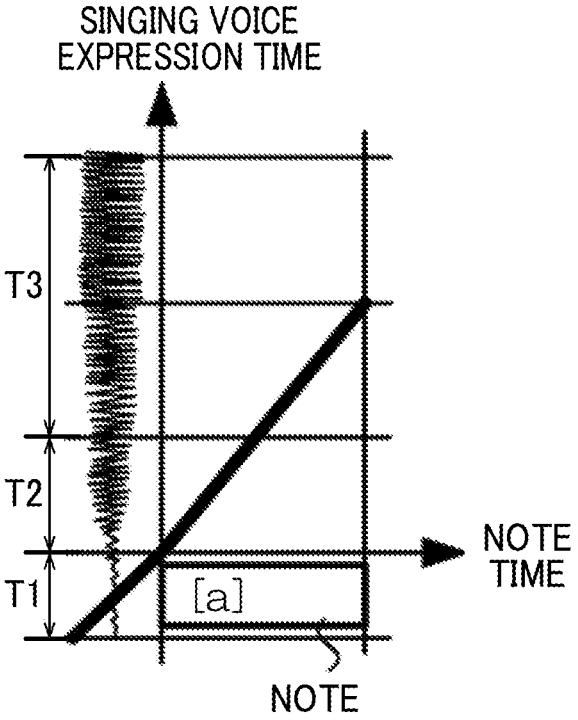
FIG. 13C is a diagram illustrating a mapping function in an example in which the time length of the expressive sample is long.
Figure 13D:
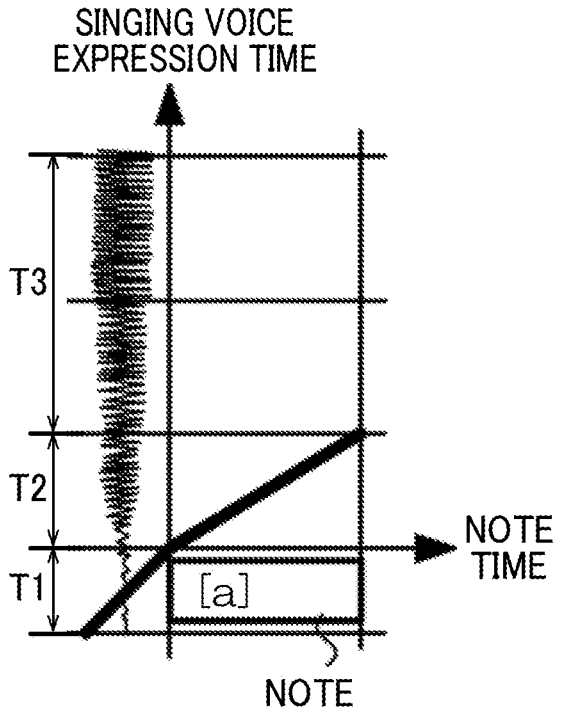
FIG. 13D is a diagram illustrating a mapping function in an example in which the time length of the expressive sample is long.

In FIG. 13A, the temporal expansion/contraction mapper 22 makes the slope of the mapping function in the sustain section T3 steeper than those in the pre-section T1 and the onset section T2. For example, the temporal expansion/contraction mapper 22 shortens a time of the entire sample by increasing the data readout speed of the expressive sample. FIG. 13B illustrates an example in which a time of the entire sample is shortened by discontinuing data reading in the midst of the sustain section T3, while keeping the readout speed in the sustain section T3 constant. Since the acoustic features of the sustain section T3 are steady, not using an end of the sample while keeping a constant data readout speed rather than changing the data readout speed would yield a natural synthesized voice. FIG. 13C illustrates a mapping function that is used when a time of the synthesized voice is shorter than a sum of time lengths of the pre-section T1 and the onset section T2 of the expressive sample. In this example, the temporal expansion/contraction mapper 22 increases the data readout speed in the onset section T2 so that the end point of the onset section T2 aligns with the end point of the synthesized voice. FIG. 13D illustrates another example of the mapping function that is used when the time of the synthesized voice is shorter than the sum of the time lengths of the pre-section T1 and the onset section T2 of the expressive sample. In this example, the temporal expansion/contraction mapper 22 shortens the time of the entire sample by discontinuing data readout in the midst of the onset section T2 while keeping a constant data readout speed within the onset section T2. In the example of FIG. 13D, one must be careful in determining the fundamental frequency. The pitch of the onset section T2 is often different from the pitch of the note. Accordingly, when the end of the onset section T2 is not used, the fundamental frequency of the synthesized voice does not reach the pitch of the note and a voice may sound out of order (tone deafness). In order to avoid this, the temporal expansion/contraction mapper 22 determines a representative value of the fundamental frequencies corresponding to the pitch of the note in the onset section T2, and shifts the fundamental frequency of the entire expressive sample so that the fundamental frequency matches the pitch of the note. As the representative value of the fundamental frequency, for example, the fundamental frequency at the end of the onset section T2 is used.

FIGS. 12A to 12D and FIGS. 13A to 13D illustrate temporal expansion/contraction mapping for the singing voice expression with the attack reference. The same concept applies to temporal expansion/contraction mapping for the singing voice expression with the release reference. That is, in the singing voice expression with the release reference, the offset section T4 and the post section T5 are feature portions, and the temporal expansion/contraction mapping is performed for these portions, by using an algorithm different from that for other portions.

The short-time spectrum operator 23 in FIG. 11 extracts several components (spectral features) from a short-time spectrum of the expressive sample through frequency analysis. The short-time spectrum operator 23 obtains a series of short-time spectra of the synthesized voice to which the expression of the singing voice has been imparted, by morphing a part of the extracted components onto the same component of the synthesized voice. The short-time spectrum operator 23 extracts from the short-time spectrum of the expressive sample, one or more of the following components, for example: (a) amplitude spectrum envelope; (b) amplitude spectrum envelope contour; (c) phase spectrum envelope; (d) temporal fine variation of amplitude spectrum envelope (or harmonic amplitude); (e) temporal fine variation of phase spectrum envelope (or harmonic phase); and (f) fundamental frequency. It is of note that it is necessary to perform the above extraction on the synthesized voice also, in order to independently morph those components between the expressive samples and the synthesized voice, but the information on the components is sometimes generated during the synthesis in the singing voice synthesizer 20A. In such a case, the thus generated components may be used. Hereinafter, each of the components will be described.

The amplitude spectrum envelope is a contour of the amplitude spectrum, and mainly relates to perception of lyrics and individuality. A large number of methods of obtaining the amplitude spectrum envelope has been proposed. For example, a cepstrum coefficient is estimated from the amplitude spectrum, and a low order coefficient (a coefficient group having an order equal to or lower than a predetermined order a) among the estimated cepstrum coefficients is used as the amplitude spectrum envelope. An important point of this embodiment is to treat the amplitude spectrum envelope independently of other components. Assuming, when the expressive sample having different lyrics or individuality from the synthesized voice is used, and if the amount of morphing regarding the amplitude spectrum envelope is set to zero, then 100% of lyrics and individuality of an original synthesized voice appears in the synthesized voice to which the expression of the singing voice has been imparted. Therefore, the expressive sample can be applied even if it has different lyrics or individuality from the synthesized voice (for example, other lyrics of a person himself or herself or samples of completely different persons). Conversely, if a user desires to intentionally change the lyrics or individuality of the synthesized voice, the amount of morphing for the amplitude spectrum envelope may be set to an appropriate amount that is not zero, and morphing may be carried out independently from morphing of other components of the expression of the singing voice.

The amplitude spectrum envelope contour is a contour in which the amplitude of the amplitude spectrum envelope is expressed more roughly and, mainly relates to the brightness of a voice. The amplitude spectrum envelope contour can be obtained in various ways. For example, coefficients having a lower order than the amplitude spectrum envelope (a group of coefficients having an order equal to or lower than an order b that is lower than the order a) among the estimated cepstrum coefficients are used as the amplitude spectrum envelope contour. Information on the lyrics or individuality is not substantially included in the amplitude spectrum envelope contour, unlike the amplitude spectrum envelope. Therefore, the brightness of the voice included in the expression of the singing voice and a temporal variation thereof can be imparted to the synthesized voice by morphing amplitude spectrum envelope contour components regardless of whether or not to carry out morphing of the amplitude spectrum envelope.

The phase spectrum envelope is a contour of the phase spectrum. The phase spectrum envelope can be obtained in various ways. For example, the short-time spectrum operator 23 first analyzes a short-time spectrum in a frame with a variable length and a variable amount of shift synchronized with a cycle of a signal. For example, a frame with a window width n times a fundamental cycle T (=1/F0) and the amount of shift m times (m<n) the fundamental cycle T is used (for example, m and n are natural numbers). A fine variation can be extracted with high temporal resolution by using the frame synchronized with the cycle. Thereafter, the short-time spectrum operator 23 extracts only a value of a phase in each harmonic component, discards other values at this stage, and carries out phase interpolation for other frequencies (between a harmonic and a harmonic) than the harmonic component, so that a phase spectrum envelope that is not a phase spectrum is obtained. For the interpolation, nearest neighbor interpolation or linear or higher order curve interpolation can be used.

Figure 14:
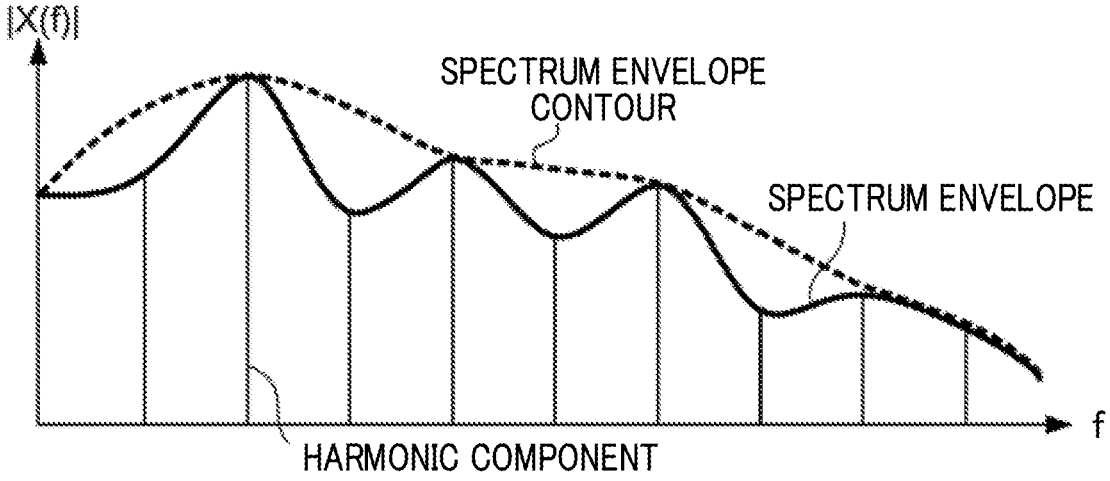
FIG. 14 is a diagram illustrating a relationship between an amplitude spectrum envelope and an amplitude spectrum envelope contour.

FIG. 14 is a diagram illustrating a relationship between the amplitude spectrum envelope and the amplitude spectrum envelope contour. A temporal variation in the amplitude spectrum envelope and a temporal variation in the phase spectrum envelope correspond to components that vary at high speed in a voice spectrum in a very short time, and correspond to texture (dry and rough sensation) specific to a thick voice, a husky voice, or the like. A temporal fine variation of the amplitude spectrum envelope can be obtained by obtaining a difference between estimated values of amplitudes on a time axis or by obtaining a difference between a value thereof smoothed in a fixed time section and a value in a frame of interest. The temporal fine variation of the phase spectrum envelope can be obtained by obtaining a difference between phase values on the time axis with respect to the phase spectrum envelope or by obtaining a difference between a value thereof smoothed in a fixed time section and a value in a frame of interest. All of these processes correspond to certain types of high pass filters. When the temporal fine variation of any spectrum envelope is used as the spectral features, it is necessary to remove this temporal fine variation from the spectrum envelope and the envelope contour corresponding to the fine variation. Here, the spectrum envelope or the spectrum envelope contour in which the temporal fine variation is not included is used.

When both the amplitude spectrum envelope and the amplitude spectrum envelope contour are used as the spectral features, morphing of (a) amplitude spectrum envelope (for example, FIG. 14) is not carried out in the morphing process, but (a') morphing of a difference between the amplitude spectrum envelope contour and the amplitude spectrum envelope, and (b) morphing of the amplitude spectrum envelope contour should instead be performed. For example, when the amplitude spectrum envelope and the amplitude spectrum envelope contour are separated as shown in FIG. 14, information on the amplitude spectrum envelope contour is included in the amplitude spectrum envelope, and the amplitude spectrum envelope and the amplitude spectrum envelope contour cannot be independently controlled. Accordingly, the amplitude spectrum envelope and the amplitude spectrum envelope contour are separated into (a') and (b) and treated separately. When the amplitude spectrum envelope and the amplitude spectrum envelope contour are separated in this way, information on an absolute volume is included in the amplitude spectrum envelope contour. When the strength of a human voice is changed, individuality or a lyrical property can be kept to a certain extent, but the volume and the overall inclination of the spectrum often change at the same time. Therefore, it makes sense to include information on the volume in the amplitude spectrum envelope contour.

A harmonic amplitude and a harmonic phase may be used in place of the amplitude spectrum envelope and the phase spectrum envelope. The harmonic amplitude is a sequence of amplitudes of respective harmonic components constituting a harmonic structure of a voice, and the harmonic phase is a sequence of phases of the respective harmonic components constituting the harmonic structure of the voice. Whether to use the amplitude spectrum envelope and the phase spectrum envelope or to use the harmonic amplitude and the harmonic phase depends on a selection of a synthesis scheme by the synthesizer 24. When synthesis of a pulse train or synthesis using a time-varying filter is performed, the amplitude spectrum envelope and the phase spectrum envelope are used, and the harmonic amplitude and the harmonic phase are used in a synthesis scheme based on a sinusoidal model like SMS, SPP, or WBHSM.

The fundamental frequency mainly relates to perception of a pitch. The fundamental frequency cannot be obtained through simple interpolation between the two frequencies, unlike the other features of the spectrum. This is because a pitch of a note in the expressive sample and a pitch of a note of the synthesized voice are generally different from each other, and even when the fundamental frequency of the expressive sample and the fundamental frequency of the synthesized voice are synthesized at the simply interpolated fundamental frequency, a pitch completely different from the pitch to be synthesized is obtained. Therefore, in the embodiment, the short-time spectrum operator 23 first shifts the fundamental frequency of the entire expressive sample by a certain amount so that the pitch of the expressive sample matches the pitch of the note of the synthesized voice. This process is not for matching the fundamental frequency as of each time of the expressive sample with that of the synthesized voice. Therefore, a dynamic variation in the fundamental frequency included in the expressive sample is retained.

Figure 15:
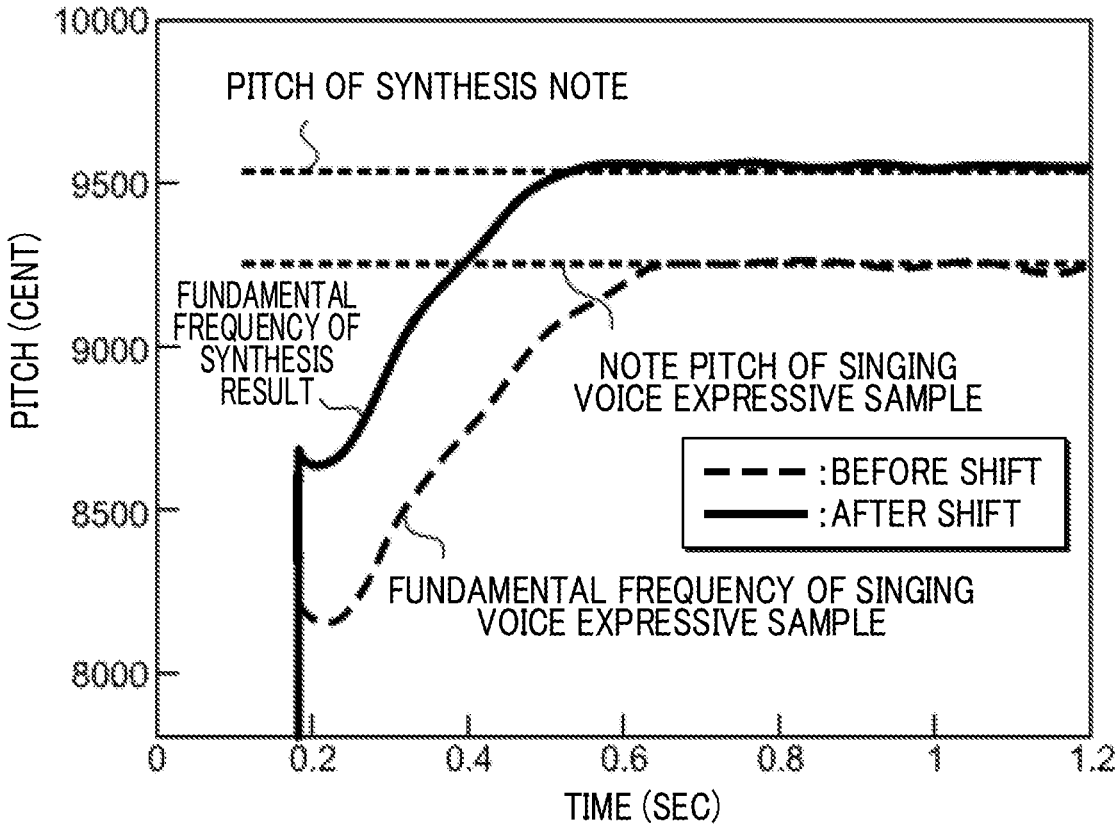
FIG. 15 is a diagram illustrating a process of shifting a fundamental frequency of an expressive sample.

FIG. 15 is a diagram illustrating a process of shifting a fundamental frequency of an expressive sample. In FIG. 15, a broken line indicates characteristics of an expressive sample before shifting is carried out (that is, recorded in the database 10), and a solid line indicates characteristics after shifting. In this process, no shifting in a time axis direction is carried out, and an entire characteristic curve of the sample is shifted, as it is, in a pitch axis direction instead, so that a fundamental frequency of the sustain section T3 will be a desired frequency with the variation in the fundamental frequencies in the pre-section T1 and the onset section T2 maintained. In morphing the fundamental frequency of the expression of the singing voice, the short-time spectrum operator 23 interpolates a fundamental frequency F0p shifted by this shifting process and a fundamental frequency F0v in ordinary singing voice synthesis according to the amount of morphing for each time, and outputs the synthesized fundamental frequency F0vp.

Figure 16:
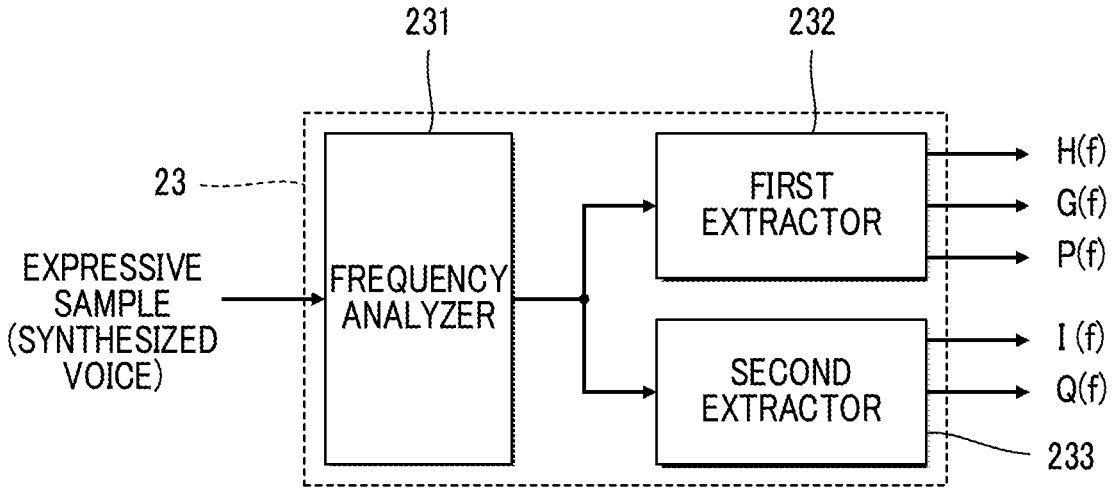
FIG. 16 is a block diagram illustrating a configuration of a short-time spectrum operator 23.

FIG. 16 is a block diagram illustrating a specific configuration of the short-time spectrum operator 23. As shown in FIG. 16, the short-time spectrum operator 23 includes a frequency analyzer 231, a first extractor 232, and a second extractor 233. For each frame, the frequency analyzer 231 sequentially calculates spectra (amplitude spectrum and phase spectrum) in a frequency domain from expressive samples in a time domain and estimates a cepstrum coefficient of a spectrum. For the calculation of the spectra in the frequency analyzer 231, short-time Fourier transformation using a predetermined window function is used.

The first extractor 232 extracts, for each frame, an amplitude spectrum envelope H(f), an amplitude spectrum envelope contour G(f), and a phase spectrum envelope P(f) from spectra calculated by the frequency analyzer 231. The second extractor 233 calculates a difference between the amplitude spectrum envelopes H(f) of the temporally successive frames as a temporal fine variation I(f) of the amplitude spectrum envelope H(f) for each frame. Similarly, the second extractor 233 calculates a difference between the temporally successive phase spectrum envelopes P(f) as a temporal fine variation Q(f) of the phase spectrum envelope P(f). The second extractor 233 may calculate a difference between any one amplitude spectrum envelope H(f) and a smoothed value (for example, an average value) of amplitude spectrum envelopes H(f) as a temporal fine variation I(f). Similarly, the second extractor 233 may calculate a difference between any one phase spectrum envelope P(f) and a smoothed value of phase spectrum envelopes P(f) as a temporal fine variation Q(f). H(f) and G(f) extracted by the first extractor 232 are the amplitude spectrum envelope and the envelope contour from which the fine variation I(f) has been removed, and P(f) extracted by the first extractor 232 is the phase spectrum envelope from which the fine variation Q(f) has been removed.

It is of note that although the case in which the short-time spectrum operator 23 extracts the spectral features from the expressive sample is given as an example for convenience in the above description, the short-time spectrum operator 23 may extract the spectral features from the synthesized voice generated by the singing voice synthesizer 20A, using the same method. Depending on a synthesis scheme of the singing voice synthesizer 20A, the short-time spectrum and/or a part or the entirety of the spectrum features is likely to be included in the singing voice synthesis parameter, and in this case, the short-time spectrum operator 23 may receive these pieces of data from the singing voice synthesizer 20A, in which case the calculation may be omitted. Alternatively, the short-time spectrum operator 23 may extract the spectral features of the expressive sample in advance prior to the input of the synthesized voice and stores the spectral features in a memory, and when the synthesized voice is input, the short-time spectrum operator 23 may read out the spectral features of the expressive sample from the memory and output the spectral features. It is possible to reduce the amount of processing per unit time performed when the synthesized voice is input.

The synthesizer 24 synthesizes the synthesized voice with the expressive sample to obtain a synthesized voice to which the expression of the singing voice has been imparted. There are various methods of synthesizing the synthesized voice with the expressive sample and obtaining a waveform of the resultant voice in the time domain in the end. These methods can be roughly classified into two types depending on how an input spectrum is expressed. One of the methods is a method based on harmonic components and the other is a method based on the amplitude spectrum envelope.

As a synthesis method based on harmonic components, for example, SMS is known (Serra, Xavier, and Julius Smith. "Spectral modeling synthesis: A sound analysis/synthesis system based on a deterministic plus stochastic decomposition." Computer Music Journal 14.4 (1990): 12-24). The spectrum of a voiced sound is expressed by a frequency, amplitude, and phase of a sinusoidal component at a fundamental frequency and at substantially integral multiples of the fundamental frequency. When the spectrum is generated by SMS and inverse Fourier transformation is performed, a waveform corresponding to several periods multiplied by a window function can be obtained. After dividing the waveform by the window function, only the vicinity of a center of a synthesis result is cut out by another window function and added in an overlapping manner in an output result buffer. This process is repeated at frame intervals such that a continuous waveform of a long duration can be obtained.

As a synthesis method based on the amplitude spectrum envelope, for example, NBVPM (Bonada, Jordi. "High quality voice transformations based on modeling radiated voice pulses in frequency domain." Proc. Digital Audio Effects (DAFx). 2004) is known. In this example, the spectrum is expressed by the amplitude spectrum envelope and the phase spectrum envelope, and does not include the fundamental frequency or the frequency information of harmonic components. When this spectrum is subjected to inverse Fourier transformation, a pulse waveform corresponding to vocal cord vibration for one cycle and a vocal tract response thereto is obtained. This is added in an overlapping manner in an output buffer. In this case, when phase spectrum envelopes in the spectra of adjacent pulses have substantially the same value, a reciprocal number of a time interval for addition in an overlapping manner in the output buffer becomes a final fundamental frequency of the synthesized voice.

For synthesis of the synthesized voice with the expressive sample, there are a method of carrying out the synthesis in a frequency domain and a method of carrying out the synthesis in a time domain. In either method, the synthesis of the synthesized voice with the expressive sample is basically performed in accordance with the following procedure. First, the synthesized voice and the expressive sample are morphed relative to components other than the temporal fine variation component of the amplitude and the phase. Then, the synthesized voice to which the expression of the singing voice has been imparted is generated by adding the temporal fine variation components of the amplitudes and the phases of the respective harmonic components (or frequency bands proximate to the harmonic components).

It is of note that, when the synthesized voice is synthesized with the expressive sample, temporal expansion/contraction mapping different from that for components other than the temporal fine variation component may be used only for the temporal fine variation component. This is effective, for example, in two cases below.

The first case is a case in which the user intentionally has changed the speed of the expression of the singing voice. The speed of the variation or the periodicity of the temporal fine variation component is closely related to texture of a voice (for example, texture such as "rustling", "scratchy", or "fizzy"), and when the variation speed is changed, the texture of the voice is altered. For example, when the user inputs an instruction to increase a speed of the expression of the singing voice in the expression of the singing voice in which a pitch decreases at an end as shown in FIG. 8, it is inferred that the user specifically intends to increase a speed of change in tone color or texture while decreasing the pitch, but does not intend to change the texture itself of the expression of the singing voice. Therefore, in order to obtain the expression of the singing voice as intended by the user, a data readout speed of the post section T5 may be increased through linear temporal expansion/contraction for components such as the fundamental frequency and the amplitude spectrum envelope, but for the temporal fine variation component, a loop is performed in an appropriate cycle (similar to the sustain section T3 in FIG. 12B) or a random-mirror-loop is performed (similar to the sustain section T3 in FIG. 12C).

The second case is a case where, in an expression of the singing voice, a cycle at which the temporal fine variation component varies should depend on the fundamental frequency. In the expression of the singing voice including periodic modulation in an amplitude and a phase of a harmonic component, it is empirically known that a voice may be heard naturally when temporal correspondence to the fundamental frequency is maintained with respect to a cycle at which an amplitude and a phase vary. An expression of the singing voice having such texture is referred to, for example, as "rough" or "growl". A scheme that can be used for maintaining the temporal correspondence to the fundamental frequency with respect to the cycle at which the amplitude and the phase vary is to apply, to a data readout speed of a temporal fine variation component, the same ratio as a conversion ratio of a fundamental frequency that is applied when a waveform of an expressive sample is synthesized.

The synthesizer 24 of FIG. 11 synchronizes the synthesized voice with the expressive samples for a section in which the expressive samples are positioned. That is, the synthesizer 24 imparts the expression of the singing voice to the synthesized voice. Morphing of the synthesized voice and the expressive sample is performed on at least one of the spectral features (a) to (f) described above. Which of the spectral features (a) to (f) is to be morphed is preset for each expression of the singing voice. For example, an expression of the singing voice such as crescendo or decrescendo as a musical term is primarily related to a temporal change in the vocal strength. Therefore, a main spectral feature to be morphed is the amplitude spectrum envelope contour. The lyrics and the individuality are considered not to be the main spectral features constituting crescendo or decrescendo. Accordingly, when the user sets the amount of morphing (a coefficient) of the amplitude spectrum envelope to zero, the expressive sample of the crescendo created from the singing voice of one lyric of a particular singer can be applied to all lyrics of all singers. In another example, in an expression of the singing voice such as vibrato, the fundamental frequency periodically varies, and the volume also varies in synchronization with the fundamental frequency. Therefore, the spectral features for which a large amount of morphing is to be set are the fundamental frequency and the amplitude spectrum envelope contour.

Further, the amplitude spectrum envelope is a spectrum feature related to the lyrics. Accordingly, the expression of the singing voice can be imparted without affecting the lyrics by setting the amount of morphing of the amplitude spectrum envelope to zero, because, by thus setting, the amplitude spectrum envelope is excluded from the spectrum features to be morphed. For example, in the expression of the singing voice in which the sample is recorded for only specific lyrics (for example, /a/), when the amount of morphing of the amplitude spectrum envelope is set to zero, the expressive sample can be morphed for a synthesized voice of lyrics other than the specific lyrics without problems.

Thus, the spectral features to be morphed can be limited for each type of expression of the singing voice. The user may limit the spectrum features that are to be morphed as described above or may set all spectral features as those to be morphed regardless of a type of expression of the singing voice. When a large number of spectral features are to be morphed for a portion, a synthesized voice close to an original expressive sample can be obtained, such that naturalness of the portion is improved. However, since a greater difference will be resulted in voice quality from a portion to which the expression of the singing voice is not imparted, discomfort is likely to appear when the entire singing voice is heard. Therefore, in templating spectral features to be morphed, spectral features that are morphing targets are determined in consideration of a balance between naturalness and discomfort.

Figure 17:
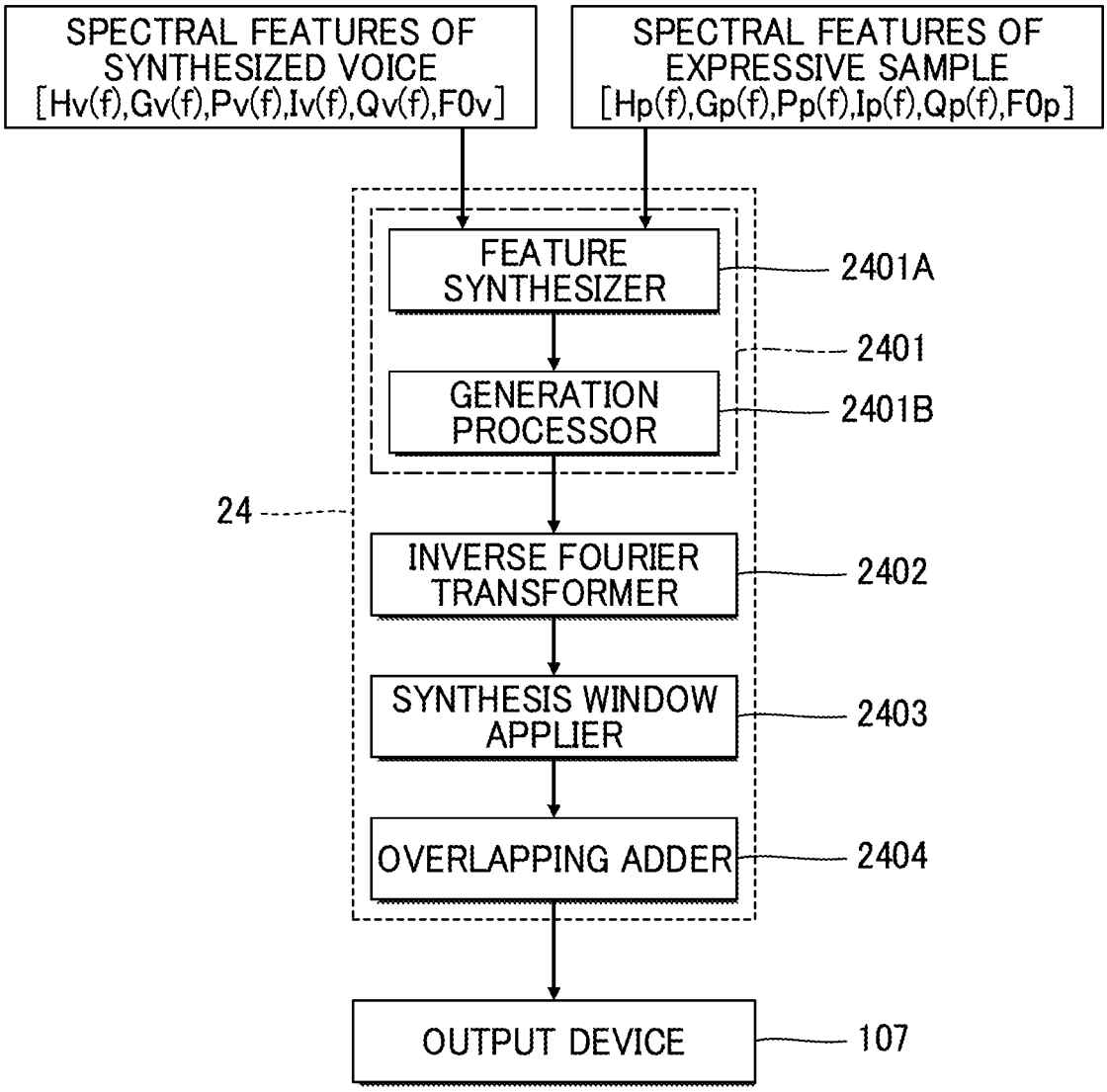
FIG. 17 is a diagram illustrating a functional configuration of a synthesizer 24 for synthesis in a frequency domain.

FIG. 17 is a diagram illustrating a functional configuration of the synthesizer 24 for synthesizing the synthesized voice with the expressive sample in the frequency domain. In this example, the synthesizer 24 includes a spectrum generator 2401, an inverse Fourier transformer 2402, a synthesis window applier 2403, and an overlapping adder 2404.

Figure 18:
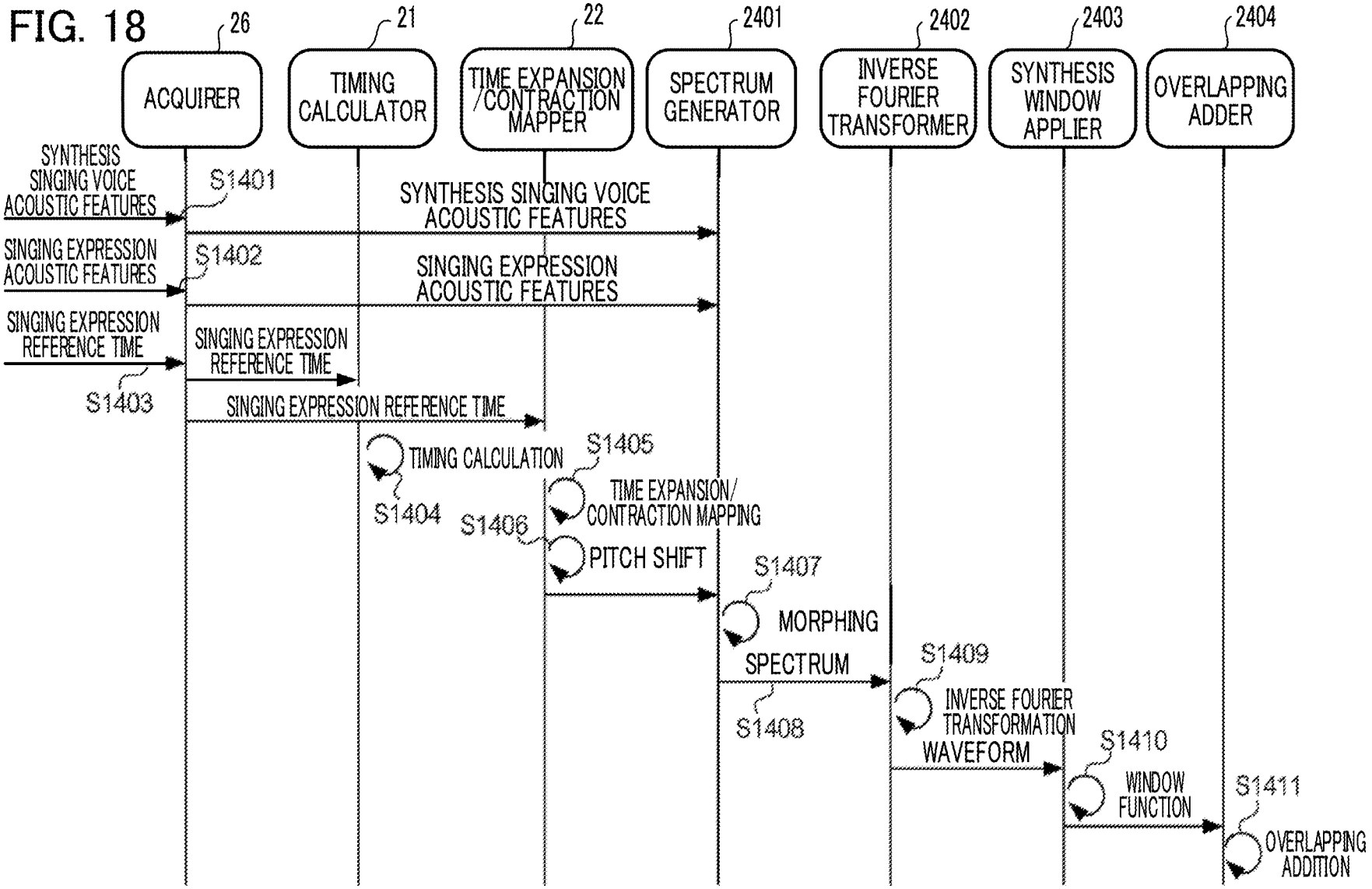
FIG. 18 is a sequence chart illustrating an operation of a synthesizer 20.

FIG. 18 is a sequence chart illustrating an operation of the synthesizer 20 (the CPU 101). The identifier 25 identifies a sample to be used for impartment of an expression of the singing voice from the singing voice expression database included in the database 10. For example, a sample of the expression of the singing voice selected by the user can be used.

In step S1401, the acquirer 26 acquires a temporal change in the spectral features of the synthesized voice generated by the singing voice synthesizer 20A. The spectral features acquired here includes at least one of the amplitude spectrum envelope H(f), the amplitude spectrum envelope contour G(f), the phase spectrum envelope P(f), the temporal fine variation I(f) of the amplitude spectrum envelope, the temporal fine variation Q(f) of the phase spectrum envelope, or the fundamental frequency F0. It is of note that the acquirer 26 may acquire, for example, the spectrum features extracted by the short-time spectrum operator 23 from the singing sample to be used for generation of a synthesized voice.

In step S1402, the acquirer 26 acquires the temporal change in the spectral features used for impartment of the expression of the singing voice. The spectral feature(s) acquired here are basically the same type(s) as that (those) used for generation of a synthesized voice. In order to distinguish the spectral features of the synthesized voice and the spectral features of the expressive sample from each other; a subscript v is assigned to the spectral features of the synthesized voice, a subscript p is assigned to the spectral features of the expressive samples; and a subscript vp is assigned to the synthesized voice to which the expression of the singing voice has been imparted. The acquirer 26 acquires, for example, the spectral features that the short-time spectrum operator 23 has extracted from the expressive sample.

In step S1403, the acquirer 26 acquires the expression reference time set for the expressive sample to be imparted. The expression reference time acquired here includes at least one of the singing voice expression start time, the singing voice expression end time, the note onset start time, the note offset start time, the note onset end time, or the note offset end time, as described above.

In step S1404, the timing calculator 21 calculates a timing (a position on the time axis) at which the expressive sample is aligned with the note (synthesized voice), using data on the feature point of the synthesized voice determined by the singing voice synthesizer 20A and the expression reference time recorded with regard to the expressive sample. As will be understood from the above description, step S1404 is a process of positioning the expressive sample (for example, a series of amplitude spectrum envelope contours) with respect to the synthesized voice on the time axis so that the feature point (for example, the vowel start time, the vowel end time, and the pronunciation end time) of the synthesized voice on the time axis is aligned with the expression reference time of the sample.

In step S1405, the temporal expansion/contraction mapper 22 performs temporal expansion/contraction mapping on the expressive sample according to a relationship between a time length of the note and the time length of the expressive sample. As will be understood from the above description, step S1405 is a process of expanding or contracting the expressive sample (for example, a series of amplitude spectrum envelope contours) on the time axis to be matched with the time length of a period (for example, a note) of a part in the synthesized voice.

In step S1406, the temporal expansion/contraction mapper 22 shifts a pitch of the expressive sample so that the fundamental frequency F0v of the synthesized voice matches the fundamental frequency F0p of the expressive sample (that is, so that the pitches of the synthesized voice and the expressive sample match each other). As will be understood from the above description, step S1406 is a process of shifting a series of pitches of the expressive sample on the basis of a pitch difference between the fundamental frequency F0v (for example, a pitch designated in the note) of the synthesized voice and a representative value of the fundamental frequencies F0p of the expressive sample.

As shown in FIG. 17, the spectrum generator 2401 of the embodiment includes a feature synthesizer 2401A and a generation processor 2401B. In step S1407, for each of the spectrum features, the feature synthesizer 2401A of the spectrum generator 2401 multiplies each of the synthesized voice and the expressive sample by the amount of morphing, and then adds the results. For example, with regard to the amplitude spectrum envelope contour G(f), the amplitude spectrum envelope H(f), and the temporal fine variation I(f) of the amplitude spectrum envelope, the synthesized voice and the expressive sample are morphed using:

$$Gvp(f)=(1-aG)Gv(f)+aG\cdot Gp(f) \quad (1)$$

$$Hvp(f)=(1-aH)Hv(f)+aH\cdot Hp(f) \quad (2)$$

$$Ivp(f)=(1-aI)Iv(f)+aI\cdot Ip(f) \quad (3),$$

where aG, aH, and aI are amounts of morphing for the amplitude spectrum envelope contour G(f), the amplitude spectrum envelope H(f), and the temporal fine variation I(f) of the amplitude spectrum envelope, respectively. As described above, in the actual processing, the morphing of (2) may not be morphing of (a) the amplitude spectrum envelope H(f), but (a') a difference between the amplitude spectrum envelope contour G(f) and the amplitude spectrum envelope H(f) can be performed instead as the morphing of (2). Further, the synthesis of the temporal fine variation I(f) may be performed in the frequency domain as in (3) (FIG. 17) or in the time domain as in FIG. 19. As will be understood from the above description, step S1407 is a process of changing a shape of the synthesized voice spectrum (an example of the synthesis spectrum) by carrying out morphing in which the expressive sample is used. Specifically, a series of spectra of the synthesized voice is altered on the basis of a series of amplitude spectrum envelope contours Gp(f) and a series of amplitude spectrum envelopes Hp(f) of the expressive sample. Further, the series of spectra of the synthesized voice is changed on the basis of at least one of a series of temporal fine variations Ip(f) of the amplitude spectrum envelope or a series of the temporal minute variations Qp(f) of the phase spectrum envelope in the expressive sample.

In step S1408, the generation processor 2401B of the spectrum generator 2401 generates and outputs a spectrum that is defined by the spectrum features as of after the synthesis by the feature synthesizer 2401A. As will be understood from the above description, steps S1404 to S1408 of the embodiment correspond to an altering step of obtaining a series of spectra to which the expression of the singing voice has been imparted (an example of a series of changed spectra) by altering the series of spectra of the synthesized voice (an example of a series of synthesis spectra) on the basis of the series of the spectral features of the expressive sample of the expression of the singing voice.

When the spectrum generated by the spectrum generator 2401 is input, the inverse Fourier transformer 2402 performs an inverse Fourier transformation on the input spectrum (step S1409) and outputs a waveform in the time domain. When the waveform in the time domain is input, the synthesis window applier 2403 applies a predetermined window function to the input waveform (step S1410) and outputs the result. The overlapping adder 2404 adds the waveform to which the window function has been applied, in an overlapping manner (step S1411). By repeating this process at frame intervals, a continuous waveform of a long duration can be obtained. The obtained waveform of the singing voice is played back by the output device 107 such as a speaker. As will be understood from the above description, steps S1409 to S1411 of the embodiment correspond to a synthesizing step of synthesizing a series of voice samples to which the expression of the singing voice has been imparted, on the basis of a series of spectra to which the expression of the singing voice has been imparted (a series of changed spectra).

The method of FIG. 17 for carrying out all synthesis in the frequency domain has an advantage that it is possible to suppress the amount of calculation since it is not necessary to execute multiple synthesis processes. However, in order to morph the fine variation components of the amplitude and the phase, it is necessary to perform morphing in a frame synchronized with the fundamental cycle T, and the singing voice synthesizer (2401B to 2404 in FIG. 17) is limited to a singing voice synthesizer suitable for this. Among general voice synthesizers, there is a type in which control is performed according to some kind of rule even when a frame for a synthesis process is constant or even when the frame is variable. In this case, voice waveforms cannot be synthesized in frames synchronized with a fundamental cycle T unless the voice synthesizer is modified to use the synchronized frames. On the other hand, there is a problem that the characteristics of the synthesized voice are changed when the voice synthesizer is modified as such.

Figure 19:
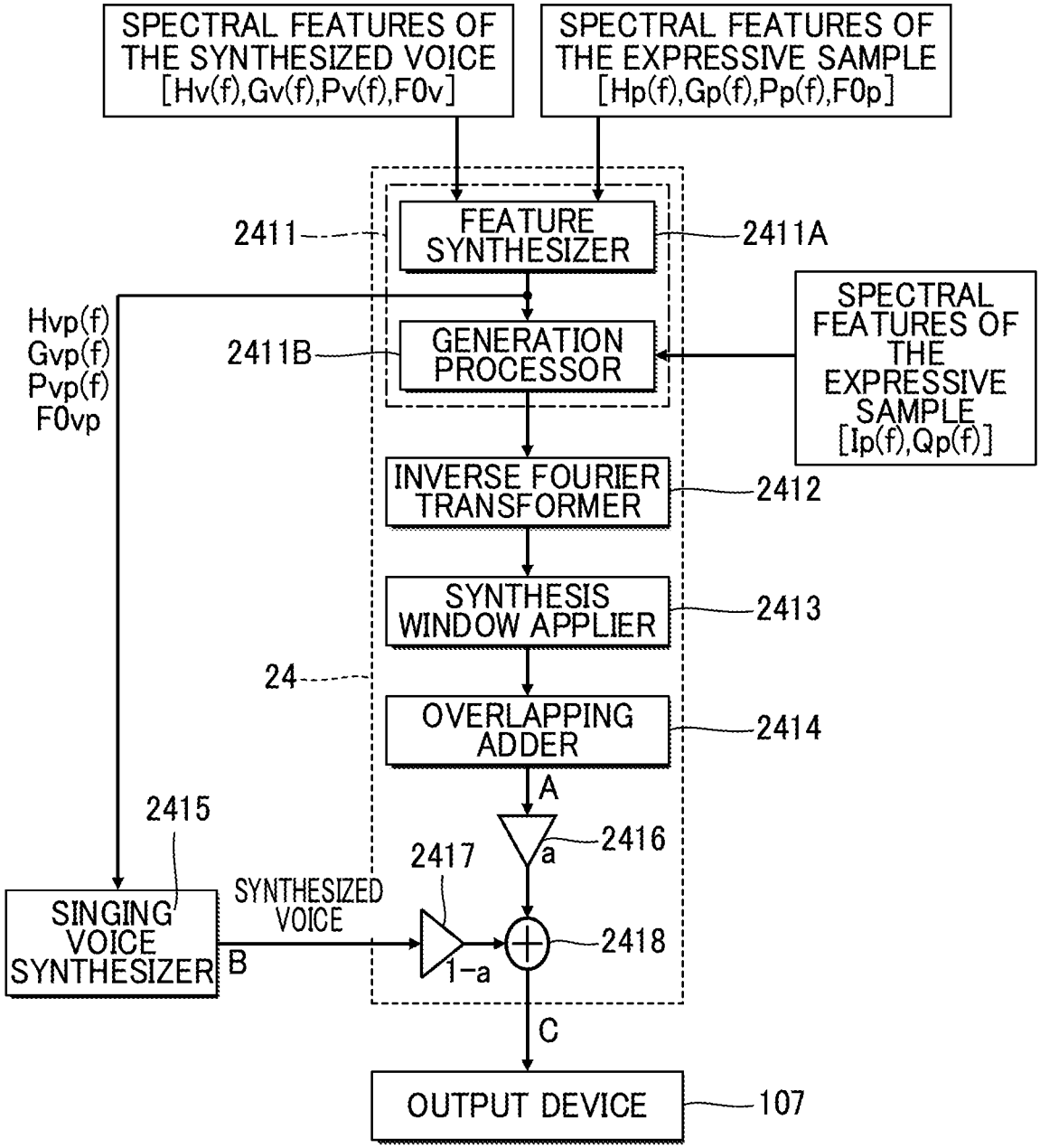
FIG. 19 is a diagram illustrating a functional configuration of a synthesizer 24 for synthesis in a time domain.

FIG. 19 is a diagram illustrating a functional configuration of the synthesizer 24 when synthesis of temporal fine variations is performed in the time domain in the synthesis process of the synthesized voice and the expressive sample. In this example, the synthesizer 24 includes a spectrum generator 2411, an inverse Fourier transformer 2412, a synthesis window applier 2413, an overlapping adder 2414, a singing voice synthesizer 2415, a multiplier 2416, a multiplier 2417, and an adder 2418. In order to maintain the quality of the fine variation, each of 2411 to 2414 performs a process in units of frames synchronized with the fundamental cycle T of the waveform.

The spectrum generator 2411 generates a spectrum of the synthesized voice to which the expression of the singing voice has been imparted. The spectrum generator 2411 of the embodiment includes a feature synthesizer 2411A and a generation processor 2411B. For each frame, the amplitude spectrum envelope H(f), the amplitude spectrum envelope contour G(f), the phase spectrum envelope P(f), and the fundamental frequency F0 for each of the synthesized voice and the expressive sample are input to the feature synthesizer 2411A. The feature synthesizer 2411A synthesizes (morphs) the input spectral features (H(f), G(f), P(f), and F0) between the synthesized voice and the expressive sample for each frame, and outputs the synthesized features. It is of note that the synthesized voice and the expressive sample are input and synthesized only in a section in which the expressive sample is positioned among the entire section of the synthesized voice, and in the remaining section, the feature synthesizer 2411A receives only the spectral features of the synthesized voice and outputs the spectral features as they are.

For each frame, the temporal fine variation Ip(f) of the amplitude spectrum envelope and the temporal fine variation Qp(f) of the phase spectrum envelope that the short-time spectrum operator 23 has extracted from the expressive sample are input to the generation processor 2411B. The generation processor 2411B generates and outputs a spectrum having fine variations according to the temporal fine variation Ip(f) and the temporal fine variation Qp(f) with a shape according to the spectrum features as of after the synthesis by the feature synthesizer 2401A for each frame.

The inverse Fourier transformer 2412 performs, for each frame, an inverse Fourier transformation on the spectrum generated by the generation processor 2411B to obtain a waveform in a time domain (that is, a series of voice samples). The synthesis window applier 2413 applies a predetermined window function to the waveform of each frame obtained through the inverse Fourier transformation. The overlapping adder 2414 adds the waveforms for a series of frames, to each of which waveforms the window function has been applied, in an overlapping manner. By repeating these processes at frame intervals, a continuous waveform A (a voice signal) of a long duration can be obtained. This waveform A shows a waveform in the time domain of the synthesized voice to which the expression of the singing voice has been imparted, where the fundamental frequency of the expression of the singing voice is shifted and the expression of the singing voice includes the fine variation.

The amplitude spectrum envelope Hvp(f), the amplitude spectrum envelope contour Gvp(f), the phase spectrum envelope Pvp(f), and the fundamental frequency F0vp of the synthesized voice are input to the singing voice synthesizer 2415. Using a known singing voice synthesis scheme, for example, the singing voice synthesizer 2415 generates a waveform B (a voice signal) in the time domain of the synthesized voice to which the expression of the singing voice has been imparted, where the fundamental frequency of the expression of the singing voice is shifted on the basis of these spectral features and the expression of the singing voice does not include the fine variation.

The multiplier 2416 multiplies the waveform A from the overlapping adder 2414 by an application coefficient a of the fine variation component. The multiplier 2417 multiplies the waveform B from the singing voice synthesizer 2415 by a coefficient (1−a). The adder 2418 adds together the waveform A from the multiplier 2416 and the waveform B from the multiplier 2417, to output a mixed waveform C.

In the method of synthesizing the fine variations in the time domain (FIG. 19), it is not necessary for a frame of the synthesized voice for which the singing voice synthesizer 2415 carries out synthesis, to be aligned with a frame from which the short-time spectrum operator 23 extracts the spectral features of the expressive sample including the fine variation. The fine variations can be synthesized by using the singing voice synthesizer 2415 as it is, without modifying a type of singing voice synthesizer 2415 that cannot use the synchronized frame. In addition, with this method, a fine variation can be imparted to not only the spectrum of the synthesized voice, but also to a spectrum obtained through frequency analysis of the singing voice in a fixed frame. As described above, a window width and a time difference (that is, an amount of shift between preceding and succeeding window functions) of a window function applied to the expressive sample by the short-time spectrum operator 23 are set to a variable length according to a fundamental cycle (a reciprocal of a fundamental frequency) of the expressive sample. For example, in a case where the window width and the time difference of the window function are set to integral multiples of the fundamental cycle, features with good quality can be extracted and processed.

For the fine variation component, the method of carrying out synthesis in the time domain handles only a portion in which the waveform A is synthesized within a short frame. According to this method, it is not necessary for the singing voice synthesizer 2415 to be of a scheme suitable for a frame synchronized with the fundamental cycle T. In this case, in the singing voice synthesizer 2415, for example, a scheme such as spectral peak processing (SPP) (Jordi Bonada, Alex Loscos. "Sample-based singing voice synthesizer by spectral concatenation." Proceedings of Stockholm Music Acoustics Conference. 2003) can be used. The SPP synthesizes a waveform that does not include a temporal fine variation and in which a component corresponding to texture of a voice has been reproduced according to a spectrum shape around a harmonic peak. In a case where an expression of the singing voice is imparted to a voice synthesized by an existing singing voice synthesizer adopting such a method, it is simple and convenient to adopt a method of synthesizing a fine variation in a time domain since an existing singing voice synthesizer can be used as it is. It is of note that in a case in which the synthesis is carries out in the time domain, waveforms are canceled with each other or beats are generated if phases are different between a synthesized voice and an expressive sample. In order to avoid this problem, the same fundamental frequency and the same phase spectrum envelope are used in the synthesizer for the waveform A and the synthesizer for the waveform B, and reference positions (so-called pitch marks) of a voice pulse for each cycle are matched between the synthesizers.

It is of note that since a value of the phase spectrum obtained by analyzing the voice through short-time Fourier transformation or the like generally has uncertainty with respect to $\theta+n2\pi$, that is, an integer n, morphing the phase spectrum envelope may sometimes involve difficulty. Since an influence of the phase spectrum envelope on the perception of the voice is less than other spectral features, the phase spectrum envelope may not be necessarily synthesized and an arbitrary value may be imparted instead. An example of the simplest and most natural method for determining the phase spectrum envelope includes a method of using a minimum phase calculated from the amplitude spectrum envelope. In this case, an amplitude spectrum envelope H(f)+G(f) excluding the fine variation component is first obtained from the H(f) and G(f) in FIG. 17 or 19, and a minimum phase corresponding thereto is obtained and supplied to each synthesizer as the spectrum envelope P(f). For example, a method using a cepstrum (Oppenheim, Alan V., and Ronald W. Schafer. Discrete-time signal processing. Pearson Higher Education, 2010) can be used as a method of calculating a minimum phase corresponding to a freely-selected amplitude spectrum envelope.

2-3. UI Unit 30

2-3-1. Functional Configuration

Figure 20:
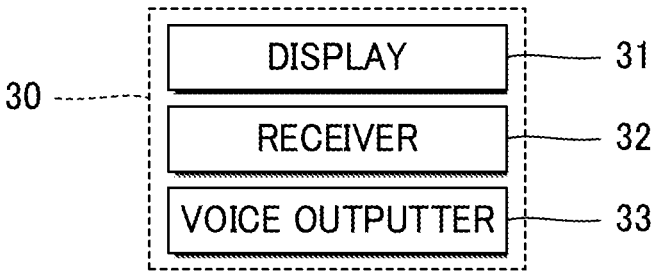
FIG. 20 is a diagram illustrating a functional configuration of a UI unit 30.

FIG. 20 is a diagram illustrating a functional configuration of the UI unit 30. The UI unit 30 includes a display 31, a receiver 32, and a voice outputter 33. The display 31 displays a screen that serves as a UI. The receiver 32 receives an operation via the UI. The voice outputter 33 is formed by the output device 107 described above, and outputs the synthesized voice according to an operation received via the UI. The UI displayed by the display 31 includes, for example, an image object for simultaneously changing values of parameters that are used for synthesis of the expressive sample to be imparted to the synthesized voice, as is described below. The receiver receives an operation with respect to this image object.

2-3-2. Example of UI (Overview)

Figure 21:
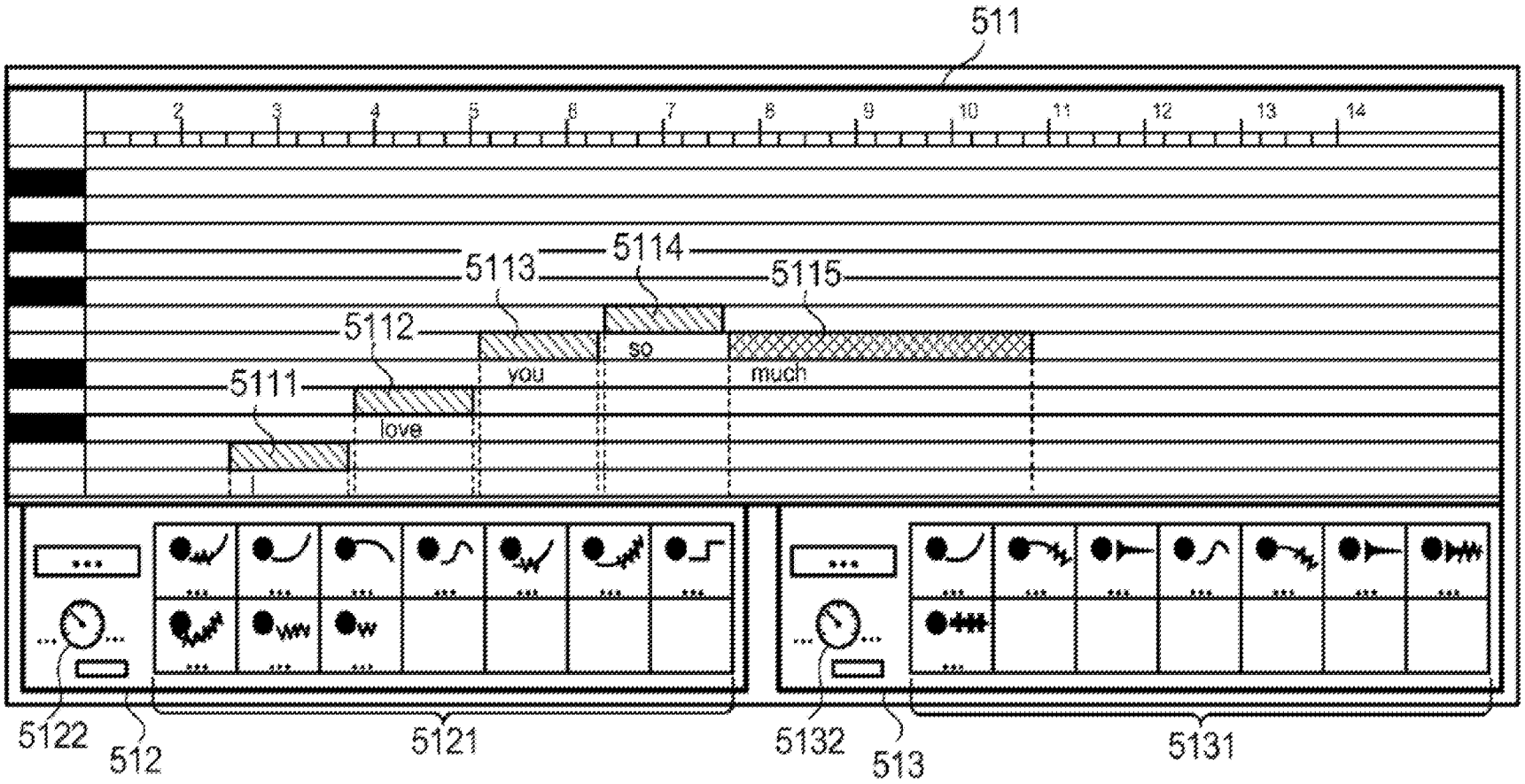
FIG. 21 is a diagram illustrating a GUI that is used in the UI unit 30.

FIG. 21 is a diagram illustrating a GUI that is used in the UI unit 30. This GUI is used in a singing voice synthesis program according to an embodiment. This GUI includes a score display area 511, a window 512, and a window 513. The score display area 511 is an area in which a score related to singing voice synthesis is displayed. In this example, the score is expressed in a piano roll format. In the score display area 511, the horizontal axis indicates time and the vertical axis indicates a scale. In this example, image objects corresponding to five notes 5111 to 5115 are displayed. Lyrics are assigned to each note. In this example, lyrics "I", "love", "you", "so", and "much" are assigned to the notes 5111 to 5115. The user clicks on the piano roll to add a new note at a freely-selected position on the score. For a note depicted in the score, attributes such as a position on the time axis, a scale, or a length of the note are edited by an operation such as dragging and dropping. Lyrics corresponding to one song may be input in advance and automatically assigned to each note according to a predetermined algorithm, or alternatively the user can manually assign lyrics to each note.

The window 512 is an area in which there are displayed image objects indicating operators for imparting the singing voice expression with the attack reference to one or more notes selected in the score display area 511. The window 513 is an area in which there are displayed image objects indicating operators for imparting the singing voice expression with the release reference to one or more notes selected in the score display area 511. The selection of the note in the score display area 511 is performed by a predetermined operation (for example, left-button click of a mouse).

2-3-3. Example of UI (Selection of an Expression of the Singing Voice)

Figure 22:
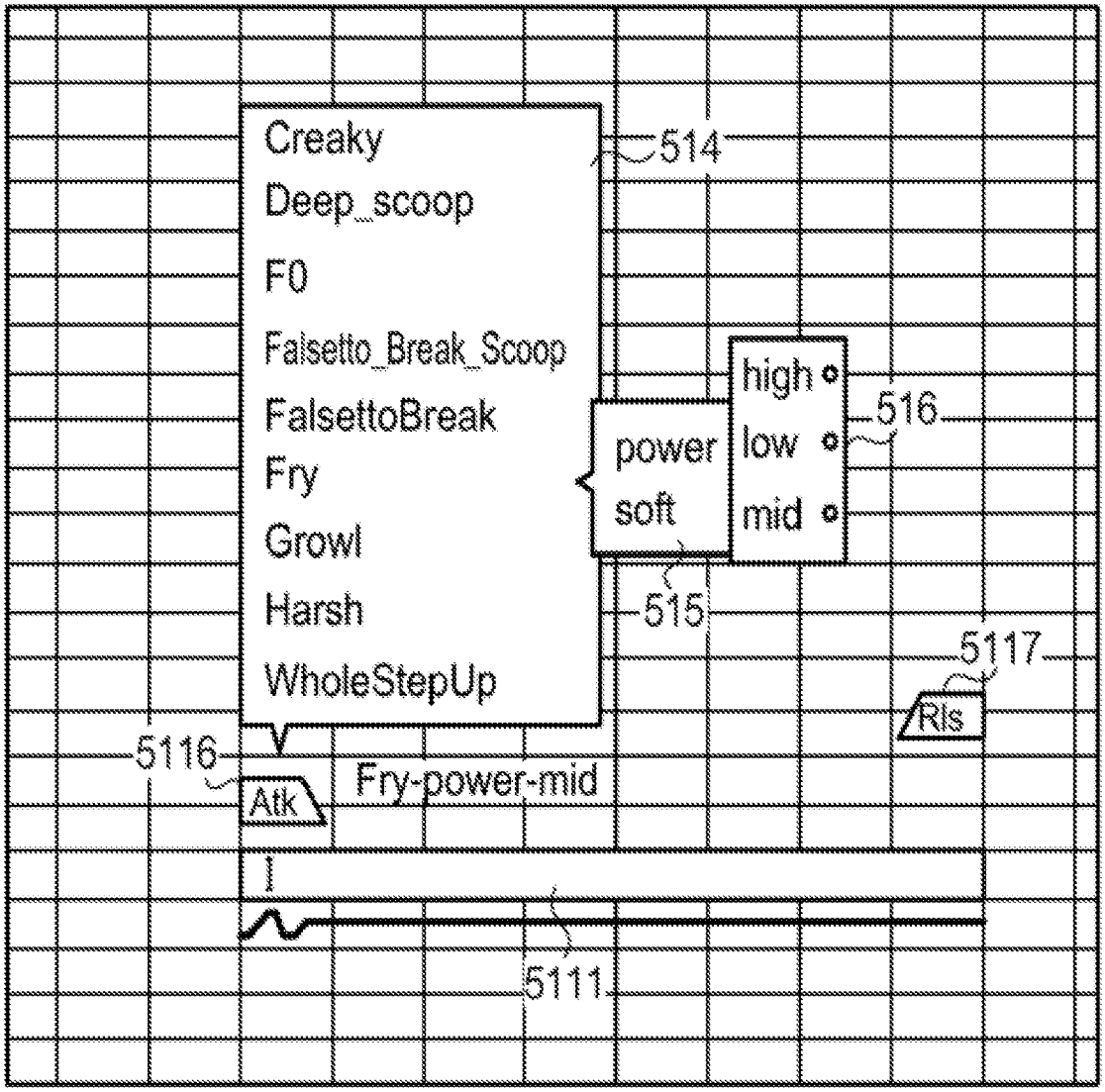
FIG. 22 is a diagram illustrating a UI for selecting an expression of the singing voice.

FIG. 22 is a diagram illustrating a UI for selection of the expression of the singing voice. In this UI a pop-up window is employed. When a user performs a predetermined operation (for example, a right-button click of the mouse), on a time axis for a note to which the user wishes to impart the expression of the singing voice, a pop-up window 514 is displayed. The pop-up window 514 is a window for selecting a first layer from among a variety of singing voice expressions that are organized in a hierarchical tree structure, and includes a display of options. When the user performs a predetermined operation (for example, a left-button click of the mouse) on any one of the options included in the pop-up window 514, a pop-up window 515 is displayed. The pop-up window 515 is a window for selecting a second layer of the organized expressions of the singing voice. When the user carries out an operation to select an option in the pop-up window 515, a pop-up window 516 is displayed. The pop-up window 516 is a window for selecting a third layer of the organized expressions of the singing voice. The UI unit 30 outputs information to the synthesizer 20 that specifies the expression of the singing voice selected via the UI in FIG. 22. Thus, the user is able to select a desired expression of the singing voice from within the organized structure and impart the expression of the singing voice to the note.

Accordingly, in the score display area 511, an icon 5116 and an icon 5117 are displayed proximate to a note 5111. The icon 5116 is an icon (an example of an image object) for instructing editing of the singing voice expression with the attack reference when the singing voice expression with the attack reference is imparted, and the icon 5117 is an icon for instructing editing of the singing voice expression with the release reference when the singing voice expression with the release reference is imparted. For example, when the user clicks the right button of the mouse in a state in which a mouse pointer is positioned on the icon 5116, a pop-up window 514 for selecting the singing voice expression with the attack reference is displayed, and thus the user is able to change the expression of the singing voice to be imparted.

Figure 23:
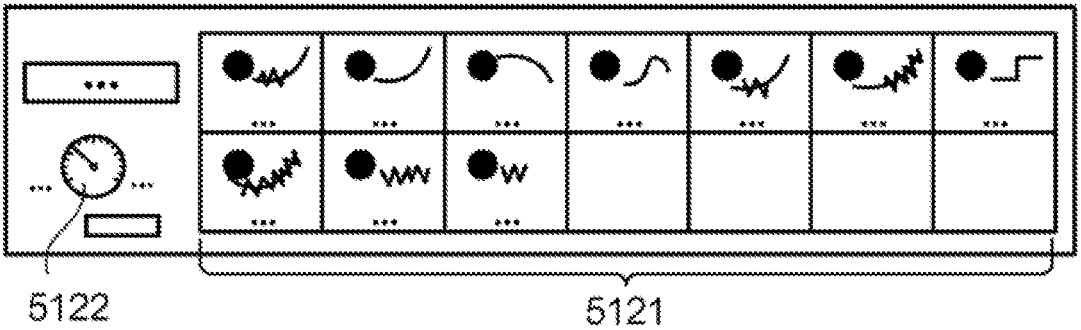
FIG. 23 is a diagram illustrating another example of the UI for selecting an expression of the singing voice.

FIG. 23 is a diagram illustrating another example of the UI that selects an expression of the singing voice. In this example, in the window 512, image objects for selecting singing voice expressions with the attack reference are displayed. Specifically, multiple icons 5121 are displayed in the window 512. Each of the icons represents the expression of the singing voice. In this example, ten types of recorded singing voice expressions are stored in the database 10, and ten types of icons 5121 are displayed in the window 512. The user selects from among the icons 5121 in the window 512 an icon that corresponds to the expression of the singing voice to be imparted, where the user has selected in the score display area 511 one or more target notes. The user selects an icon in the window 513 in a manner similar to that used for also for the singing voice expression with the release reference. The UI unit 30 outputs to the synthesizer 20 information specifying the expression of the singing voice selected via the UI of FIG. 23. Based on the output information, the synthesizer 20 generates a synthesized voice to which the expression of the singing voice has been imparted. The voice outputter 33 of the UI unit 30 outputs the generated synthesized voice.

2-3-4. Example of UI (Parameter Input for the Expression of the Singing Voice)

In the example shown in FIG. 23, an image object representative of a dial 5122 for changing an amount of the singing voice expression with the attack reference is displayed in the window 512. The dial 5122 is an example of a single operator for simultaneously changing values of parameters used for imparting the expression of the singing voice to the synthesized voice. Further, the dial 5122 is an example of an operator that is moved by operation of the user. In this example, parameters relating to the expression of the singing voice are simultaneously adjusted by operation of the single dial 5122. The degree for the singing voice expression with the release reference is similarly adjusted by use of a dial 5132 displayed in the window 513. The parameters relating to the expression of the singing voice are, for example, maximum values of an amount of morphing for the spectral features. The maximum value of the amount of morphing is a maximum value in a case where the amount of morphing changes with a lapse of time within each note. In the example shown in FIG. 2, the amount of morphing of the singing voice expression with the attack reference has a maximum value at a start point of the note, and the amount of morphing of the singing voice expression with the release reference has a maximum value at an end point of the note. The UI unit 30 has information (for example, a table) for changing the maximum value of the amount of morphing depending on a rotation angle from a reference position of the dial 5122.

Figures 24, 25:
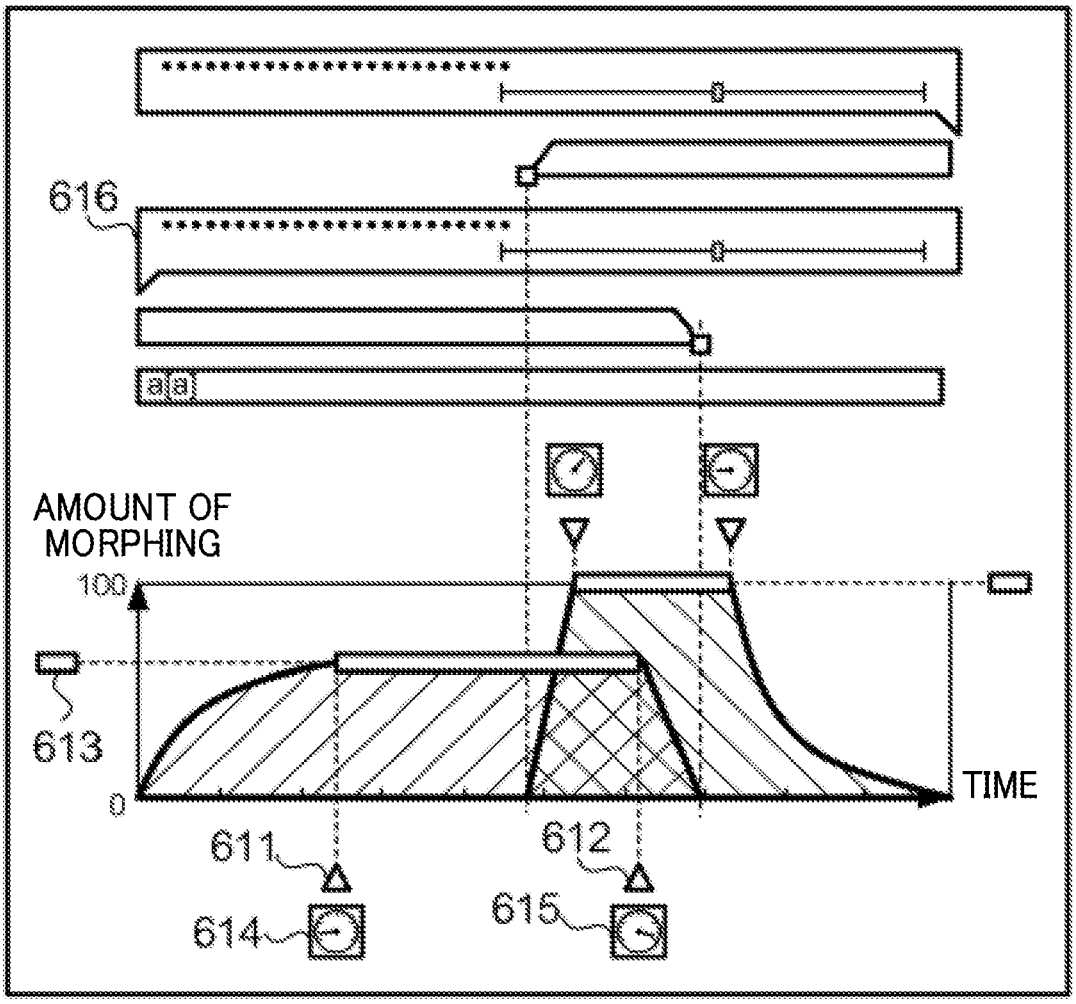
FIG. 24 is an example of a table in which a rotation angle of a dial is associated with an amount of morphing.
FIG. 25 is another example of a UI for editing parameters related to the expression of the singing voice.

FIG. 24 is a diagram illustrating a table in which the rotation angle of the dial 5122 is associated with the maximum value of the amount of morphing. This table is defined for each expression of the singing voice. For each of spectral features (for example, six spectral features including the amplitude spectrum envelope H(f), the amplitude spectrum envelope contour G(f), the phase spectrum envelope P(f), the temporal fine variation I(f) of the amplitude spectrum envelope, the temporal fine variation Q(f) of the phase spectrum envelope, and the fundamental frequency F0), a maximum value of the amount of morphing is defined by the rotation angle of the dial 5122. For example, when the rotation angle is 30°, a maximum value of the amount of morphing of the amplitude spectrum envelope H(f) is zero, and a maximum value of the amount of morphing of the amplitude spectrum envelope contour G(f) is 0.3. In this example, a value of each parameter is defined only for a discrete value of the rotation angle, while a value of each parameter is specified through interpolation for each rotation angle not defined in the table.

The UI unit 30 detects a rotation angle of the dial 5122 in response to a user operation. The UI unit 30 identifies six maximum values of the amount of morphing corresponding to the detected rotation angle by referring to the table shown in FIG. 24. The UI unit 30 outputs the identified six maximum values of the amount of morphing to the synthesizer 20. It is of note that the parameter relating to the expression of the singing voice is not limited to the maximum value of the amount of morphing. Other parameters such as an increase rate or a decrease rate of the amount of morphing can be adjusted. It is of note that the user selects a particular expression of the singing voice of a particular note in the score display area 511 as a target for editing the expression of the singing voice. In this case, the UI unit 30 sets a table corresponding to the selected expression of the singing voice as a table for reference when the dial 5122 is operated.

FIG. 25 is a diagram illustrating another example of the UI for editing the parameters relating to the expression of the singing voice. In this example, editing is carried out on a shape of a graph depicting a temporal change in the amount of morphing applied to the spectrum features of expression of the singing voice for the note selected in the score display area 511. The singing voice expression to be edited is specified by using an icon 616. An icon 611 is an image object for designating a start point of a period in which the amount of morphing takes a maximum value for the singing voice expression with the attack reference. An icon 612 is an image object for designating an end point of the period in which the amount of morphing takes a maximum value in the singing voice expression with the attack reference. An icon 613 is an image object for designating a maximum value of the amount of morphing in the singing voice expression with the attack reference. When the user moves the icons 611 to 613 by carrying out an operation such as dragging and dropping, a period in which the amount of morphing takes a maximum value changes, and a maximum value of the amount of morphing changes accordingly. A dial 614 is an image object for adjusting a shape of a curve (a profile of an increase rate of the amount of morphing) from a time point at which the expression of the singing voice starts to be applied to a time point at which the amount of morphing reaches a maximum value. When the dial 614 is operated, the curve from the start of the application of the expression of the singing voice to the amount of morphing reaching the maximum value changes, for example, from a downwardly convex profile to an upwardly convex profile through a linear profile. A dial 615 is an image object for adjusting the shape of the curve (a profile of a reduction rate of the amount of morphing) from an end point of the period in which the amount of morphing takes a maximum to an end of the application of the expression of the singing voice. When the user operates the dials 614 and 615, the shape of the curve of the change in the amount of morphing with a lapse of time of the note changes. The UI unit 30 outputs parameters specified by a graph shown in FIG. 25 to the synthesizer 20 at a timing relative to the expression of the singing voice. The synthesizer 20 generates a synthesized voice to which the expressive sample controlled by using these parameters has been added. The "synthesized voice to which the expressive sample controlled by using these parameters has been added" means, for example, a synthesized voice to which a sample processed by way of the process shown in FIG. 18 has been added. As already described, such addition can be carried out in the time domain or in the frequency domain. The voice outputter 33 of the UI unit 30 outputs the generated synthesized voice.

3. Modifications

The present disclosure is not limited to the embodiments described above, and various modifications can be made. In the following, several modifications will be described. Two or more of the following modifications may be used in combination.

(1) A target to which an expression is imparted is not limited to a singing voice and may be a voice that is not sung. That is, the expression of the singing voice may be an expression of a spoken voice. Further, a voice to which the voice expression is imparted is not limited to a voice synthesized by a computer device, and may be an actual human voice. Further, the target to which the expression of the singing voice is imparted may be a voice which is not based on a human voice.

(2) A functional configuration of the voice synthesis device 1 is not limited to the configuration shown in the embodiment. Some of the functions shown in the embodiment may be omitted. For example, at least some of the functions of the timing calculator 21, the temporal expansion/contraction mapper 22, or the short-time spectrum operator 23 may be omitted from the voice synthesis device 1.

(3) A hardware configuration of the voice synthesis device 1 is not limited to the configuration shown in the embodiment. The voice synthesis device 1 may be of any hardware configuration as long as the hardware configuration can realize required functions. For example, the voice synthesis device 1 may be a client device that works in cooperation with a server device on a network. That is, the functions of the voice synthesis device 1 may be distributed to the server device on the network and the local client device.

(4) A program that is executed by the CPU 101 or the like may be provided by a storage medium such as an optical disk, a magnetic disk, or a semiconductor memory, or may be downloaded via a communication means such as the Internet.

(5) The following are aspects of the present disclosure derivable from the specific forms exemplified above.

A voice synthesis method according to an aspect (a first aspect) of the present disclosure includes: altering a series (time series) of synthesis spectra in a partial period of a synthesis voice based on a series of amplitude spectrum envelope contours of a voice expression to obtain a series of changed spectra to which the voice expression has been imparted; and synthesizing a series of voice samples to which the voice expression has been imparted, based on the series of changed spectra.

A voice synthesis method according to a second aspect is the voice synthesis method according to the first aspect, in which the altering includes altering amplitude spectrum envelope contours of the synthesis spectrum through morphing performed based on the amplitude spectrum envelope contours of the voice expression.

A voice synthesis method according to a third aspect is the voice synthesis method according to the first aspect or the second aspect, in which the altering includes altering the series of synthesis spectra based on the series of amplitude spectrum envelope contours of the voice expression and a series of amplitude spectrum envelopes of the voice expression.

A voice synthesis method according to a fourth aspect is the voice synthesis method according to any one of the first to the third aspects, in which the altering includes positioning the series of amplitude spectrum envelope contours of the voice expression so that a feature point of the synthesized voice on a time axis aligns with an expression reference time that is set for the voice expression, and altering the series of synthesis spectra based on the positioned series of amplitude spectrum envelope contours.

A voice synthesis method according to a fifth aspect is the voice synthesis method according to the fourth aspect, in which the feature point of the synthesized voice is a vowel start time of the synthesized voice. Further, a voice synthesis method according to a sixth aspect is the voice synthesis method according to the fourth aspect, in which the feature point of the synthesized voice is a vowel end time of the synthesized voice or a pronunciation end time of the synthesized voice.

A voice synthesis method according to a seventh aspect is the voice synthesis method according to the first aspect, in which the altering includes expanding or contracting the series of amplitude spectrum envelope contours of the voice expression on a time axis to match a time length of the period of the part of the synthesized voice, and altering the series of synthesis spectra based on the expanded or contracted series of amplitude spectrum envelope contours.

A voice synthesis method according to an eighth aspect is the voice synthesis method according to the first aspect, in which the altering includes shifting a series of pitches of the voice expression based on a pitch difference between a pitch in the period of the part of the synthesized voice, and a representative value of the pitches of the voice expression, and altering the series of synthesis spectra based on the shifted series of pitches and the series of amplitude spectrum envelope contours of the voice expression.

A voice synthesis method according to a ninth aspect is the voice synthesis method according to the first aspect, in which the altering includes altering the series of synthesis spectra based on a series of at least one of amplitude spectrum envelopes or phase spectrum envelopes in the voice expression.

(6) A voice synthesis method according to a first viewpoint of the present disclosure includes the following steps:

Step 1: Receive a series of first spectrum envelopes of a voice and a series of first fundamental frequencies.

Step 2: Receive a series of second spectrum envelopes and a series of second fundamental frequencies of a voice to which a voice expression has been imparted.

Step 3: Shift the series of the second fundamental frequencies in a frequency direction so that the second fundamental frequencies match the first fundamental frequencies in a sustain section in which the fundamental frequencies are stabilized in a predetermined range.

Step 4: Synthesize the series of first spectrum envelopes with the series of second spectrum envelopes to obtain a series of third spectrum envelopes.

Step 5: Synthesize the series of first fundamental frequencies with the series of the shifted second fundamental frequencies to obtain a series of third fundamental frequencies.

Step 6: Synthesize a voice signal on the basis of the third spectrum envelopes and the third fundamental frequencies.

It is of note that step 1 may be performed before step 2 or after step 3 or may be intercede between step 2 and step 3. Further, a specific example of the "first spectrum envelope" is the amplitude spectrum envelope Hv(f), the amplitude spectrum envelope contour Gv(f), or the phase spectrum envelope Pv(f), and a specific example of the "first fundamental frequency" is the fundamental frequency F0v. A specific example of the "second spectrum envelope" is the amplitude spectrum envelope Hp(f) or the amplitude spectrum envelope contour Gp(f), and a specific example of the "second fundamental frequency" is the fundamental frequency F0p. A specific example of the "third spectrum envelope" is the amplitude spectrum envelope Hvp(f) or the amplitude spectrum envelope contour Gvp(f), and a specific example of the "third fundamental frequency" is the fundamental frequency F0vp.

(7) As described above, there is a tendency that the amplitude spectrum envelope contributes to the perception of lyrics or a vocalizer, and that the amplitude spectrum envelope contour does not depend on the lyrics and the vocalizer. Given the above tendency, for the transformation of the amplitude spectrum envelope Hv(f) of the synthesized voice, the amplitude spectrum envelope Hp(f) or the amplitude spectrum envelope contour Gp(f) of an expressive sample may be used by appropriately switching therebetween. Specifically, when a lyric or a vocalizer is substantially the same in the synthesized voice and the expressive sample, the amplitude spectrum envelope Hp(f) can be used for the deformation of the amplitude spectrum envelope Hv(f), and when the lyric or the vocalizer is not the substantially the same in the synthesized voice and the expressive sample, the amplitude spectrum envelope contour Gp(f) can be used for the deformation of the amplitude spectrum envelope Hv(f).

The voice synthesis method according to a viewpoint described above (hereafter, a "second viewpoint") includes the following steps.

Step 1: Receive a series of first spectrum envelopes of a first voice.

Step 2: Receive a series of second spectrum envelopes of a second voice to which a voice expression has been imparted.

Step 3: Determine whether or not the first voice and the second voice satisfy a predetermined condition.

Step 4: Obtain a series of third spectrum envelopes by transforming the series of first spectrum envelopes on the basis of the series of second spectrum envelopes in a case where the predetermined condition is satisfied, whereas obtain the series of third spectrum envelopes by transforming the series of first spectrum envelopes on the basis of a series of contours of the second spectrum envelopes in a case where the predetermined condition is not satisfied.

Step 5: Synthesize a voice based on the obtained series of third spectrum envelopes.

It is of note that in the second viewpoint, a specific example of the "first spectrum envelope" is the amplitude spectrum envelope Hv(f). A specific example of the "second spectrum envelope" is the amplitude spectrum envelope Hp(f), and a specific example of the "contour of the second spectrum envelope" is the amplitude spectrum envelope contour Gp(f). A specific example of the "third spectrum envelope" is the amplitude spectrum envelope Hvp(f).

In an example of the second viewpoint, determining whether the predetermined condition is satisfied includes determining that the predetermined condition is satisfied in a case where a vocalizer of the first voice and a vocalizer of the second voice are substantially the same. In another example of the second viewpoint, determining whether the predetermined condition is satisfied includes determining that the predetermined condition is satisfied in a case where lyrics of the first voice and lyrics of the second voice are substantially the same.

(8) A voice synthesis method according to a third viewpoint of the present disclosure includes the following steps.

Step 1: Acquire a first spectrum envelope and a first fundamental frequency.

Step 2: Synthesize a first voice signal in the time domain on the basis of the first spectrum envelope and the first fundamental frequency.

Step 3: Receive a fine variation of a spectrum envelope of a voice to which a voice expression has been imparted, for each frame synchronized with the voice.

Step 4: For each frame, synthesize a second voice signal in the time domain on the basis of the first spectrum envelope, the first fundamental frequency, and the fine variation.

Step 5: Mix the first voice signal and the second voice signal according to a first change amount to output a mixed voice signal.

The "first spectrum envelope" is, for example, the amplitude spectrum envelope Hvp(f) or the amplitude spectrum envelope contour Gvp(f) generated by the feature synthesizer 2411A in FIG. 19, and the "first fundamental frequency" is, for example, the fundamental frequency F0vp generated by the feature synthesizer 2411A in FIG. 19. The "first voice signal in the time domain" is, for example, an output signal from the singing voice synthesizer 2415 (specifically, the voice signal in the time domain indicating a synthesized voice) shown in FIG. 19. The "fine variation" is, for example, the temporal fine variation Ip(f) of the amplitude spectrum envelope and/or the temporal fine variation Qp(f) of the phase spectrum envelope in FIG. 19. The "second voice signal in the time domain" is, for example, an output signal from the overlapping adder 2414 shown in FIG. 19 (the voice signal in the time domain to which the fine variation has been imparted). The "first change amount" is, for example, the coefficient a or the coefficient (1−a) in FIG. 19, and the "mixed voice signal" is, for example, the output signal from the adder 2418 shown in FIG. 19.

In an example of the third viewpoint, the fine variation is extracted from the voice to which the voice expression has been imparted through frequency analysis in which the frame synchronized with the voice has been used.

In an example of the third aspect, in step 1, the first spectrum envelope is acquired by synthesizing (morphing) the second spectrum envelope of the voice with the third spectrum envelope of the voice to which the voice expression has been imparted according to a second change amount. The "second spectrum envelope" is, for example, the amplitude spectrum envelope Hv(f) or the amplitude spectrum envelope contour Gv(f), and the "third spectrum envelope" is, for example, the amplitude spectrum envelope Hp(f) or the amplitude spectrum envelope contour Gp(f). The second change amount is, for example, the coefficient aG in Equation (1) or the coefficient aH in Equation (2) described above.

In an example of the third viewpoint, in step 1, the first fundamental frequency is acquired by synthesizing the second fundamental frequency of the voice with the third fundamental frequency of the voice to which the voice expression has been imparted, according to a third change amount. The "second fundamental frequency" is, for example, the fundamental frequency F0v, and the "third fundamental frequency" is, for example, the fundamental frequency F0p.

In an example of the third viewpoint, in step 5, the first voice signal and the second voice signal are mixed in a state in which a pitch mark of the first voice signal and a pitch mark of the second voice signal substantially match on the time axis. The "pitch mark" is a feature point, on the time axis, of a shape in a waveform of the voice signal in the time domain. For example, a peak and/or a valley of the waveform is a specific example of the "pitch mark".

DESCRIPTION OF REFERENCE SIGNS

1 Voice synthesis device
10 Database
20 Synthesizer
21 Timing calculator
22 Temporal expansion/contraction mapper
23 Short-time spectrum operator
24 Synthesizer
25 Identifier
26 Acquirer
30 UI unit
31 Display
32 Receiver
33 Voice outputter
101 CPU
102 Memory
103 Storage Device
104 Input/output IF
105 Display
106 Input device
911 Score display area
912 Window

913 Window
2401 Spectrum generator
2402 Inverse Fourier transformer
2403 Synthesis window applier
2404 Overlapping adder
2411 Spectrum generator
2412 Inverse Fourier transformer
2413 Synthesis window applier
2414 Overlapping adder
2415 Singing voice synthesizer
2416 Multiplier
2417 Multiplier
2418 Adder

What is claimed is:

1. A voice synthesis method comprising:

selecting a voice expression to be imparted from among a plurality of voice expressions;

extracting a series of amplitude spectrum envelope contours of the selected voice expression frame by frame from spectra of expressive samples of the selected voice expression, wherein each frame of the extracted series of amplitude spectrum envelope contours of the selected voice expression:

expresses a corresponding one of the series of respective amplitude spectrum envelopes of the voice expression more roughly frequency-wise; and includes less information on lyrics or a singer's individuality compared with the series of the amplitude spectrum envelopes;

altering a series of synthesis spectra in a partial period; among a total period, of a synthesized voice based on the extracted series of amplitude spectrum envelope contours of the selected voice expression, to obtain a series of altered spectra to which the selected voice expression has been imparted; and synthesizing a series of voice samples of the synthesized voice to which the selected voice expression has been imparted, based on the obtained series of altered spectra.

2. The voice synthesis method according to claim 1, wherein the altering includes altering the extracted series of amplitude spectrum envelope contours of the selected voice expression through morphing performed based on the series of amplitude spectrum envelope contours of the selected voice expression.

3. The voice synthesis method according to claim 1, wherein the altering includes altering the series of synthesis spectra based on the extracted series of amplitude spectrum envelope contours of the selected voice expression and the series of amplitude spectrum envelope of the selected voice expression.

4. The voice synthesis method according to claim 1, wherein the altering includes:

positioning the extracted series of amplitude spectrum envelope contours of the selected voice expression to align a feature point of the synthesized voice on a time axis with an expression reference time that is set for the selected voice expression; and altering the series of synthesis spectra based on the positioned extracted series of amplitude spectrum envelope contours of the selected voice expression.

5. The voice synthesis method according to claim 4, wherein the feature point of the synthesized voice is a vowel start time of the synthesized voice.

6. The voice synthesis method according to claim 4, wherein the feature point of the synthesized voice is a vowel end time of the synthesized voice or a pronunciation end time of the synthesized voice.

7. The voice synthesis method according to claim 1, wherein the altering includes:

expanding or contracting the extracted series of amplitude spectrum envelope contours of the selected voice expression on a time axis to match a time length of the partial period of the synthesized voice; and altering the series of synthesis spectra based on the expanded or contracted extracted series of amplitude spectrum envelope contours of the selected voice expression.

8. The voice synthesis method according to claim 1, wherein the altering includes:

shifting a series of pitches of the selected voice expression based on a pitch difference between a pitch in the partial period of the synthesized voice and a representative value of the pitches of the selected voice expression; and altering the series of synthesis spectra based on the shifted series of pitches and the extracted series of amplitude spectrum envelope contours of the selected voice expression.

9. The voice synthesis method according to claim 1, wherein the altering further includes altering the series of synthesis spectra based on a series of phase spectrum envelopes in the selected voice expression.

10. A voice synthesis device comprising:

a memory storing instructions; and at least one processor that implements the instructions to:

select a voice expression to be imparted from among a plurality of voice expressions;

extract a series of amplitude spectrum envelope contours of the selected voice expression frame by frame from spectra of expressive samples of the selected voice expression, wherein each frame of the extracted series of amplitude spectrum envelope contours of the selected voice expression:

expresses a corresponding one of the series of respective amplitude spectrum envelopes of the voice expression more roughly frequency-wise; and includes less information on lyrics or a singer's individuality compared with the series of the amplitude spectrum envelopes;

alter a series of synthesis spectra in a partial period, among a total period, of a synthesized voice based on the extracted series of amplitude spectrum envelope contours of the selected voice expression, to obtain a series of altered spectra to which the selected voice expression has been imparted; and synthesize a series of voice samples of the synthesized voice to which the selected voice expression has been imparted, based on the obtained series of altered spectra.

11. A non-transitory computer storage medium storing a computer program executable by a computer to execute a voice synthesis method comprising;

selecting a voice expression to be imparted from among a plurality of voice expressions;

extracting a series of amplitude spectrum envelope contours of the selected voice expression frame by frame from spectra of expressive samples of the selected voice expression, wherein each frame of the extracted series of amplitude spectrum envelope contours of the selected voice expression:

expresses a corresponding one of the series of respective amplitude spectrum envelopes of the voice expression more roughly frequency-wise; and includes less information on lyrics or a singer's individuality compared with the series of the amplitude spectrum envelopes;

altering a series of synthesis spectra in a partial period, among a total period, of a synthesized voice based on the extracted series of amplitude spectrum envelope contours of the selected voice expression, to obtain a series of altered spectra to which the selected voice expression has been imparted; and synthesizing a series of voice samples of the synthesized voice to which the voice expression has been imparted, based on the obtained series of altered spectra.

12. The voice synthesis method according to claim 1, wherein the series of respective amplitude spectrum envelopes of the selected voice expression relate to perception of lyrics and a singer's individuality.

13. The voice synthesis method according to claim 1, wherein the extracted series of amplitude spectrum envelope contours of the selected voice expression relate to brightness of a voice.

14. The voice synthesis method according to claim 1, wherein each of the extracted series of amplitude spectrum envelope contours of the selected voice expression is a group of cepstrum coefficients having a lower order than the corresponding amplitude spectrum envelope of the selected voice expression.

* * * * *